US005451492A

United States Patent [19]

Merkel et al.

[11] Patent Number: 5,451,492

[45] Date of Patent: Sep. 19, 1995

[54] PHOTOGRAPHIC ELEMENTS CONTAINING CERTAIN ACYLACETANILIDE COUPLERS IN COMBINATION WITH DEVELOPMENT INHIBITOR RELEASING COUPLERS

[75] Inventors: Paul B. Merkel; Jerrold N. Poslusny; James P. Merrill, all of Rochester, N.Y.; Bernard A. Clark, Maidenhead; Paul L. R. Stanley, Harrow, both of United Kingdom

[73] Assignee: Eastman Kodak Company, Rochester, N.Y.

[21] Appl. No.: 214,722

[22] Filed: Mar. 17, 1994

[51] Int. Cl.[6] ..... G03C 1/46

[52] U.S. Cl. ..... 430/505; 430/544; 430/957; 430/557; 430/359

[58] Field of Search ..... 430/557, 544, 505, 957, 430/359

[56] References Cited

U.S. PATENT DOCUMENTS

| | | | |
|---|---|---|---|
| 3,973,968 | 8/1976 | Fujiwara et al. | 96/56.5 |
| 4,022,620 | 5/1977 | Okumura et al. | 96/56.5 |
| 4,026,706 | 5/1977 | Nakamura et al. | 96/74 |
| 4,203,768 | 5/1980 | Inouye et al. | 430/388 |
| 4,221,860 | 9/1980 | Hirose et al. | 430/379 |
| 4,266,019 | 5/1981 | Kobayashi et al. | 430/551 |
| 4,286,053 | 8/1981 | Ishikawa et al. | 430/389 |
| 4,289,847 | 9/1981 | Ishikawa et al. | 430/389 |
| 4,356,258 | 10/1982 | Usui et al. | 430/557 |
| 4,370,410 | 1/1983 | Iijima et al. | 430/506 |
| 4,567,135 | 1/1986 | Arakawa et al. | 430/505 |
| 4,578,346 | 3/1986 | Watanabe et al. | 430/548 |
| 4,622,287 | 11/1986 | Umemoto et al. | 430/505 |
| 4,791,050 | 12/1988 | Ogawa et al. | 430/506 |
| 4,980,267 | 12/1990 | Taber | 430/505 |
| 5,066,574 | 11/1991 | Kubota et al. | 430/557 |
| 5,100,771 | 3/1992 | Mihayashi et al. | 430/546 |

FOREIGN PATENT DOCUMENTS

| | | |
|---|---|---|
| 1039921 | 9/1978 | Canada . |
| 1520551 | 9/1978 | United Kingdom . |
| 9108515 | 6/1991 | WIPO . |

*Primary Examiner*—Charles L. Bowers, Jr.
*Assistant Examiner*—Geraldine Letscher
*Attorney, Agent, or Firm*—Arthur E. Kluegel

[57] ABSTRACT

The present invention provides a photographic element comprising a support bearing a blue light sensitive silver halide emulsion layer containing an acylacetanilide yellow image dye-forming coupler having formula I:

I wherein:

$R_a$ is a substituted or unsubstituted alkyl, alkoxy, or aryloxy group;

$R_b$ is a substituted or unsubstituted alkyl or aryl group;

$R_c$ is hydrogen or a substituted or unsubstituted alkyl group;

$R_1$ is a substituent;

$R_2$ is selected from the group consisting of halogen, trifluoromethyl, and substituted or unsubstituted alkoxy and aryloxy;

each $R_3$ is bonded at the 4- or 5- position relative to the anilino nitrogen and is independently a substituent selected from the group consisting of halogen, alkoxycarbonyl ($-CO_2R$), carbamoyl ($-CONRR'$), sulfonate ($-OSO_2R$), sulfamoyl ($-SO_2NRR'$), sulfonyl ($-SO_2R$), trifluoromethyl, cyano, and sulfonamido ($-NRSO_2R'$), in which each R and R' is independently hydrogen or a substituent;

q is 1 ir 2;

$R_4$ and $R_5$ are independently hydrogen or an alkyl group; and $R_6$ is a substituent;

n is an integer from 0 to (3–q);

wherein the blue light sensitive silver halide emulsion layer has associated therewith a development inhibitor releasing coupler. The invention also provides a method of forming an image in such an element.

26 Claims, No Drawings

PHOTOGRAPHIC ELEMENTS CONTAINING CERTAIN ACYLACETANILIDE COUPLERS IN COMBINATION WITH DEVELOPMENT INHIBITOR RELEASING COUPLERS

FIELD OF INVENTION

This invention relates to a photographic material comprising a certain acylacetanilide yellow image dye-forming coupler having an oxazolidine-2,4-dione coupling-off group and also comprising a development inhibitor releasing coupler. The invention also relates to a method of forming an image from such a photographic element.

BACKGROUND OF THE INVENTION

In a silver halide color photographic material a color image is formed when the element is exposed to light and then subjected to color development. The color development results in imagewise reduction of silver halide and production of oxidized primary amine developer. The oxidized primary amine developing agent subsequently reacts with one or more incorporated dye-forming couplers to form dye in an imagewise fashion.

Many photographic materials, especially color negative photographic materials, contain not only imaging couplers that serve merely as sources of imaging dyes but also image modifying couplers that after coupling with oxidized developer release a photographically useful group (PUG). Image modifying couplers that release an inhibitor group are referred to as DIR (Development Inhibitor Releasing) couplers. If the inhibitor is linked to the coupler via an intermediate timing group that may or may not serve to delay inhibitor release, it is sometimes referred to as a DIAR (Development Inhibitor Anchimeric Releasing) coupler. The term DIR couplers will be used herein to encompass both DIR and DIAR couplers.

DIR couplers perform one or more useful functions including control of contrast or gamma, sharpness enhancement, granularity reduction and color correction via interlayer interimage effects. The latter function is particularly important in modern color photographic materials. For example, DIR couplers are widely used in the blue-sensitive, yellow dye-forming layers of color negative films, not only for improved sharpness (or acutance) but also to reduce development and dye formation in other layers, especially adjacent green light-sensitive, magenta dye-forming layers. This type of interlayer interimage effect can help correct for unwanted absorptions of the yellow dyes in areas of the negative that contain magenta dyes. It also allows a film to be constructed with higher color contrast while maintaining proper neutral contrast. To date, combinations of yellow image dye-forming couplers and DIR couplers have not provided satisfactory interlayer interimage effects.

There are many references to yellow dye-forming couplers in the art. Among them are U.S. Pat. No. 3,973,968 of Fujihara et al, U.S. Pat. No. 4,022,620 of Okumura et al and U.S. Pat. No. 5,066,574 of Kubota et al, which disclose the synthesis and use of yellow dye-forming couplers with hydantoin derivatives as coupling-off groups and Canadian Patent 1,039,291 which discloses yellow dye-forming couplers with oxazolidine-2,4-dione coupling-off groups. Yellow dye-forming couplers with oxazolidine- 2,4-dione coupling-off groups are also disclosed in GB 1,520,511 and in U.S. Pat. Nos. 4,026,706, 4,203,768, 4,221,860, 4,266,019, 4,286,053, 4,289,847, 4,356,258, 4,370,410, 4,567,135, 4,578,346, 4,622,287, 4,791,050, and 5,100,771. The combination of the particular acylacetanilide yellow-dye forming couplers having oxazolidine-2,4-dione coupling-off groups of the invention together with DIR couplers is not disclosed nor is the unexpected improvement in photographic properties associated with such conjoint usage.

It would be useful to have a photographic element in which a light sensitive silver halide emulsion layer containing a yellow image dye-forming coupler and having a development inhibitor releasing coupler associated therewith would exhibit superior interimage effects.

SUMMARY OF THE INVENTION

The present invention provides a photographic element comprising a support bearing a blue light sensitive silver halide emulsion layer containing an acylacetanilide yellow image dye-forming coupler having formula I:

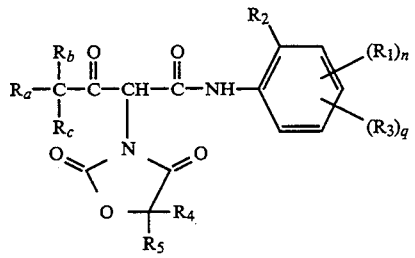

I wherein:

$R_a$ is a substituted or unsubstituted alkyl, alkoxy, or aryloxy group;

$R_b$ is a substituted or unsubstituted alkyl or aryl group;

$R_c$ is hydrogen or a substituted or unsubstituted alkyl group;

$R_1$ is a substituent;

$R_2$ is selected from the group consisting of halogen, trifluoromethyl, and substituted or unsubstituted alkoxy and aryloxy;

each $R_3$ is bonded at the 4- or 5- position relative to the anilino nitrogen and is independently a substituent selected from the group consisting of halogen, alkoxycarbonyl (—$CO_2R$), carbamoyl (—CONRR′), sulfonate (—$OSO_2R$), sulfamoyl (—$SO_2NRR'$), sulfonyl (—$SO_2R$), trifluoromethyl, cyano, and sulfonamido (—$NRSO_2R'$), in which each R and R′ is independently hydrogen or a substituent;

q is 1 or 2;

$R_4$ and $R_5$ are independently hydrogen or an alkyl group; and n is an integer from 0 to (3−q);

wherein the blue light sensitive silver halide emulsion layer has associated therewith a development inhibitor releasing coupler. The invention also provides a method of forming an image in such an element.

The element of the invention provides superior interimage effects so that improvements in the photographic properties of the resulting image such as sharpness, color rendition and the like are achieved.

DETAILED DESCRIPTION OF THE INVENTION

The acylacetanilide yellow dye-forming imaging couplers of this invention may be represented by formula I below:

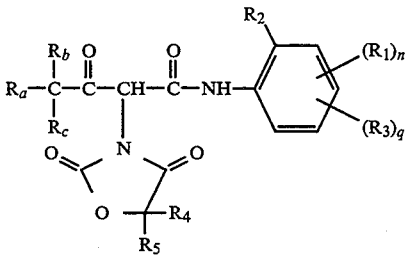

I where the substituents are as defined earlier.

References to groups, such as alkyl, aryl, alkoxy and alkoxycarbonyl groups, include both unsubstituted and substituted groups. References to aliphatic groups, such as alkyl or alkoxy, include unbranched, branched and cyclic groups.

$R_a$ is a substituted or unsubstituted alkyl, alkoxy or aryloxy group, suitably containing up to 42 carbon atoms, such as a methyl, ethyl, propyl, butyl, pentyl, hexyl, octyl, dodecyl, hexadecyl, methoxy and other alkoxy groups corresponding to the foregoing, and a phenoxy group. When $R_a$ is a substituted group, suitable substituents may include, for example, alkoxy, phenoxy and phenyl groups.

$R_b$ is a substituted or unsubstituted alkyl or aryl group, suitably containing up to 42 carbon atoms, such as a methyl, ethyl, propyl, butyl, pentyl, hexyl, octyl, dodecyl, hexadecyl, or phenyl group. It is intended that formula I as shown encompass also the situation where $R_a$ and $R_b$ are joined to form a ring of six or more members and the ring members satisfy the requirements for both $R_a$ and $R_b$. They may be combined for example, as a cyclohexyl group which may optionally be substituted.

$R_c$ is hydrogen or a substituted or unsubstituted alkyl group.

In the most preferred embodiment, each of $R_a$, $R_b$, and $R_c$ is alkyl and all may conveniently be methyl.

$R_1$ may be any substituent suitable for photographic purposes as described more fully hereafter;

$R_2$ is a halogen, such as chlorine or fluorine, an alkoxy group, an aryloxy group or a trifluomethyl group. Suitable examples of $R_2$ are: methoxy, ethoxy, and dodecyloxy;

each $R_3$ is independently a substituent chosen from halogen (such as chlorine), alkoxycarbonyl (—$CO_2R$), carbamoyl (—CONRR′), sulfonate (—$OSO_2R$), sulfamoyl (—$SO_2NRR'$), sulfonyl (—$SO_2R$), trifluoromethyl, cyano, and sulfonamido (—$NRSO_2R'$). R and R′ may be substituted or unsubstituted alkyl groups. Suitable examples of R and R′ groups are ethyl, dodecyl and hexadecyl.

In the general formula, q is 1 or 2. Thus the yellow image dye-forming coupler may contain either one or two $R_3$ groups in the anilide phenyl ring. The $R_3$ groups may be the same or different when q is 2. Each $R_3$ is in the 4- or 5- position relative to the anilino nitrogen. $R_3$ groups selected from alkoxycarbonyl groups and sulfonate groups are preferred. Also preferred are couplers of structure I in which $R_2$ is chlorine and $R_3$ is an alkoxycarbonyl group in the 4- or 5- position.

$R_4$ and $R_5$ are independently selected to be hydrogen or a substituted or unsubstituted alkyl group. Suitably, at least one of $R_4$ and $R_5$ is an alkyl group.

To minimize water solubility and coupler wandering the total number of carbon atoms contained in $R_a$, $R_b$, $R_c$, $R_1$, $R_2$, $R_3$, $R_4$ and $R_5$ taken together should be at least 12 and preferably from about 14 to 45. To minimize dye wandering the total number of carbon atoms in $R_a$, $R_b$, $R_c$, $R_1$, $R_2$ and $R_3$ taken together should be at least 9.

As used herein, the term substituent, unless otherwise specifically stated, has a broad definition. The substituent may be, for example, halogen, such as chlorine, bromine or fluorine; nitro; hydroxyl; cyano; and —$CO_2H$; and groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)-butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-tbutylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N′-ethylureido, N-phenylureido, N,N-diphenylureido, N-phenyl-N-ptoluylureido, N-(m-hexadecylphenyl)ureido, N,N-(2,5-di-t-pentylphenyl)-N′-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)-propyl]sulfamoyl, N-[4-(2,4-di-t-pentylphenoxy)butyl]-sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-toctylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 30 carbon atoms and usually less than 24 carbon atoms, but greater numbers are possible depending on the particular substituents selected. Moreover, as indicated, the substituents may themselves be suitably substituted with any of the above groups.

Examples of acylacetanilide yellow-dye forming imaging couplers with oxazolidine 2,4-dione coupling-off groups useful for the practice of this invention include, but are not limited to, I1–I20, below:

I1

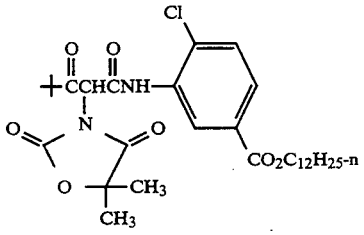

I2

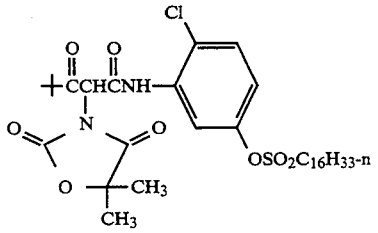

-continued

I3

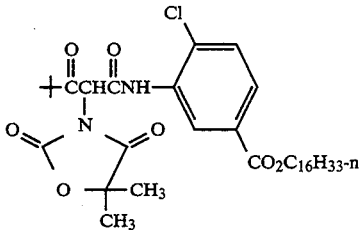

I4

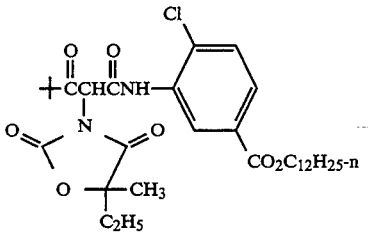

I5

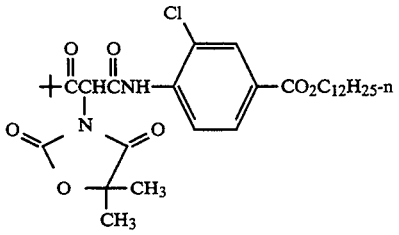

I6

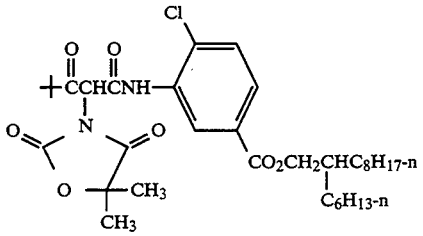

I7

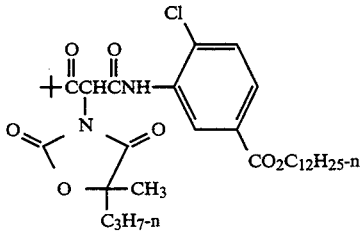

I8

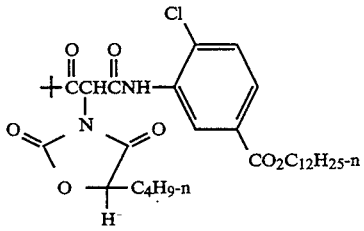

I9

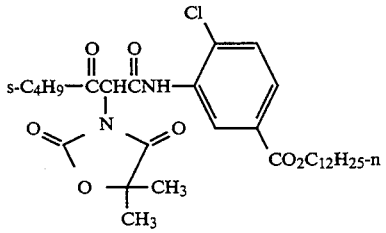

-continued

I10

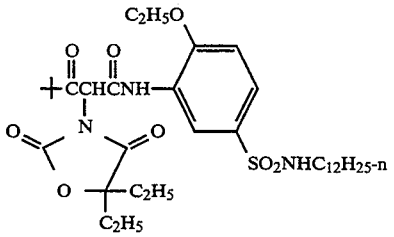

I11

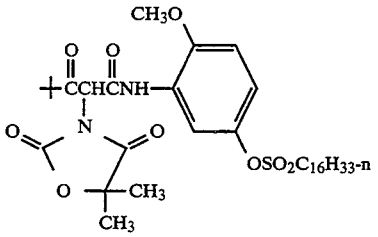

I12

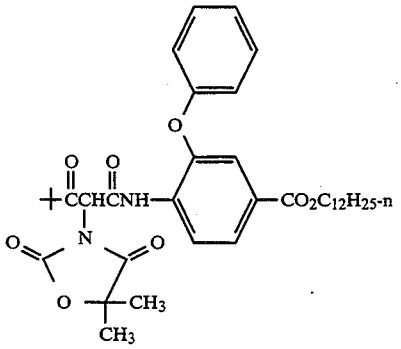

I13

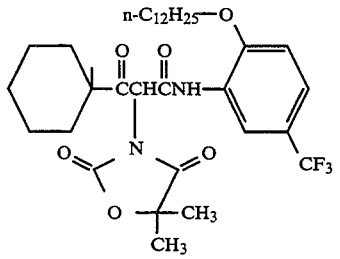

I14

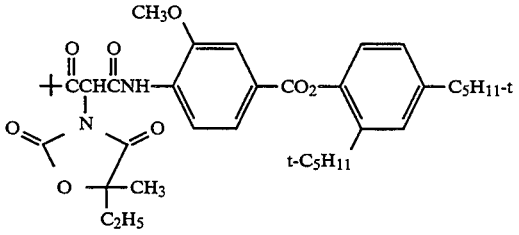

I15

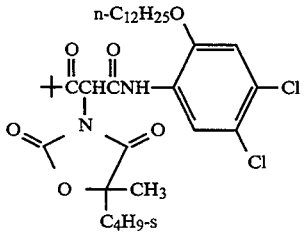

-continued

I16

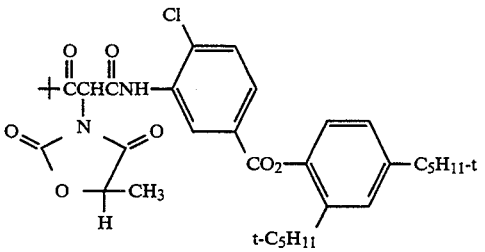

I17

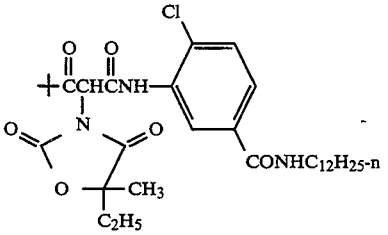

I18

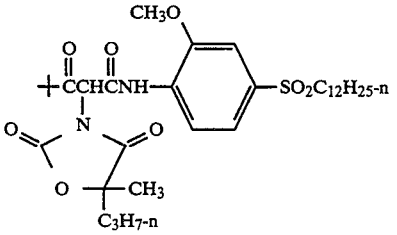

I19

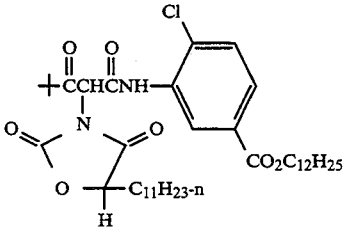

I20

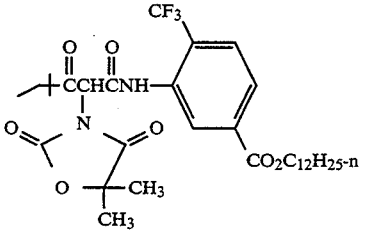

The DIR couplers useful for the practice of this invention are represented by general formulas II and III, below:

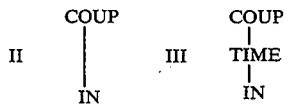

wherein:

COUP is a parent coupler moiety or residue that can react or couple with oxidized developer to form a dye. A coupler moiety that yields a yellow dye on reaction with oxidized developer is typically employed.

IN is an inhibitor moiety that is joined either directly to the coupling site of COUP or through a timing group ("TIME") and is released, with or without delay, upon COUP reacting with oxidized developer; and TIME is a group that is bonded to the coupling site of COUP and to IN that allows release of TIME-IN upon COUP reacting with oxidized developer; the release of IN from TIME-IN may or may not entail a significant time delay.

Development inhibitor moieties IN useful for the DIR couplers of this invention include oxazoles, thiazoles, diazoles, triazoles, oxadiazoles, thiadiazoles, oxathiazoles, thiatriazoles, imidazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles and benzisodiazoles. Particularly useful are IN moieties of structures IV, V, VI, VII, VIII, XIV, and XV below:

IV

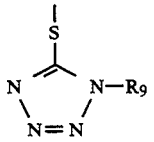

V

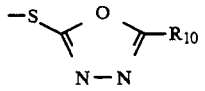

VI

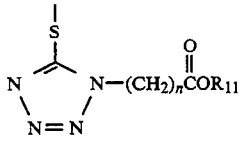

VII

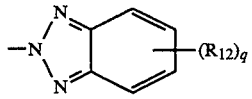

VIII

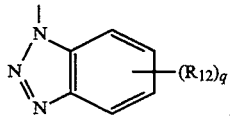

XIV

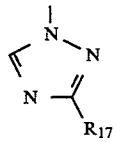

XV

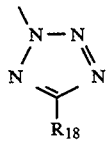

wherein:

$R_9$ is selected from the group consisting alkyl groups containing from 1 to 8 carbon atoms (including benzyl groups) and phenyl groups. When said groups are substituted, alkoxy substituents are preferred.

$R_{10}$ is selected from $R_9$ and —$SR_9$.

$R_{11}$ is an alkyl group containing 1 to 5 carbon atoms.

n is from 1 to 3.

$R_{12}$ is selected from the group consisting of alkyl, halogen, alkoxy, phenyl, —$COOR_{13}$ and —$NHCOR_{13}$, wherein $R_{13}$ is an alkyl group or a phenyl group and q is 1 or 2.

$R_{17}$ is an alkyl group, a phenyl group, —$COOR_{13}$, or —$NHCOR_{13}$.

$R_{18}$ is an alkyl group or a phenyl group.

It is generally desirable to select a DIR coupler having an IN group which is hydrolyzable as shown in U.S. Pat. No. 4,477,503, which is incorporated herein by reference. For preferred DIR couplers of this invention where a timing group is present, IN is an inhibitor moiety of structure VI. Preferred couplers of the invention without a timing group IN has formula VII or VIII in which $R_{12}$ is —$COOR_{13}$ and $R_{13}$ is an alkyl or phenyl group and q is 1.

DIR couplers which release a weak diffusible inhibitor or which release a diffusible timing group/inhibitor combination are most effective in the invention. Weak inhibitors are those having an inhibitor strength of less than about 60 as defined for example in U.S. Pat. No. 5,006,448, which is incorporated herein by reference. Where the inhibitor is attached directly to the parent group, use of an inhibitor group based on a benzotriazole is preferred.

DIR couplers with timing groups (DIAR couplers) are also desirable for use in combination with the yellow dye-forming imaging couplers of this invention. Timed inhibitor releasing groups, TIME-IN, useful for the practice of this invention include, but are not limited to those of structures IX, X, XI, XII and XIII below:

IX

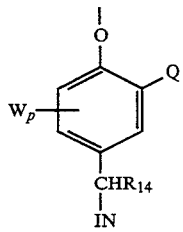

X

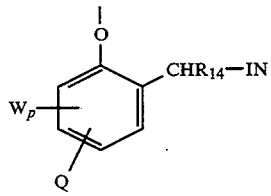

XI

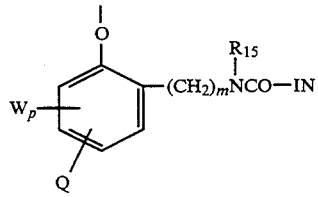

-continued

XII

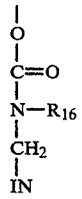

XIII

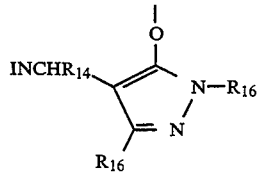

wherein:

Q and W are electron-withdrawing groups, examples of which include nitro, cyano, sulfonamido, sulfamoyl, alkylsulfonyl or carbamoyl groups, or halogen atoms, such as chlorine.

p is 0, 1 or 2;

m is 0 or 1;

$R_{14}$ is hydrogen or an alkyl group;

$R_{15}$ is an alkyl group containing 1 to 8 carbon atoms or a phenyl group;

$R_{16}$ is an alkyl group or a phenyl group; and

IN is an inhibitor moiety, such as those defined by formulas IV–VII, above.

Useful switched or timed inhibitor releasing groups for the DIR couplers of this invention also include heterocyclic groups, such as those disclosed in U.S. Pat. No. 4,421,845, and in JP-A-57-188035 JP-A-58-209736, JP-A-58-209737 and JP-A-58-209738.

Preferred DIR couplers for the practice of this invention include those of structures IX in which Q is a nitro group, $R_{14}$ is hydrogen and IN is of structure IV or VI and those of structure XI in which Q is nitro, m is 1, p is 0, $R_{15}$ is ethyl and IN is of structure IV or VI above.

Examples of DIR couplers useful for the practice of this invention include, but are not limited to, the following (D1–D24). When the IN formula includes the designation "(iso)" this indicates that the formula includes the isomers in which the benzotriazole is linked to the coupler at the 1, 2, or 3 position and mixtures thereof.

D1

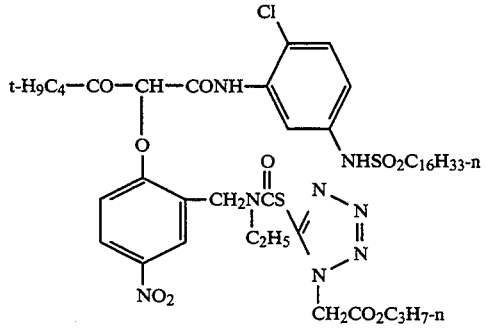

D2

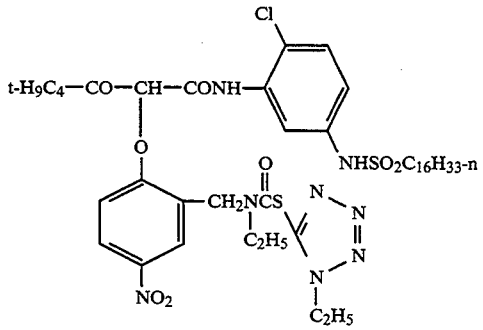

D3

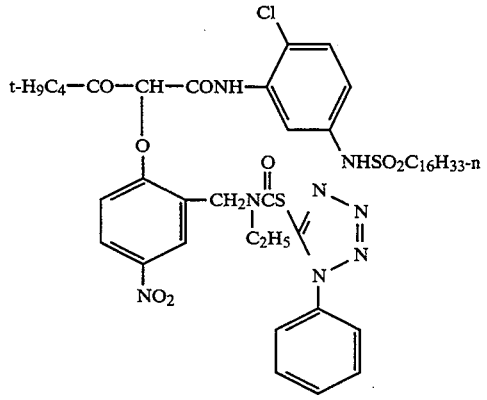

D4

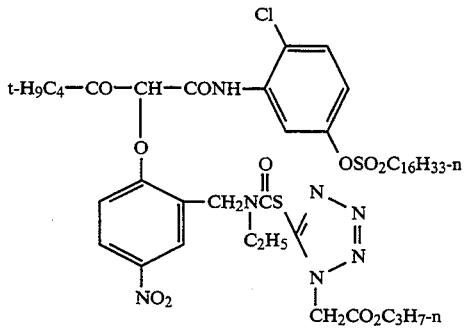

D5

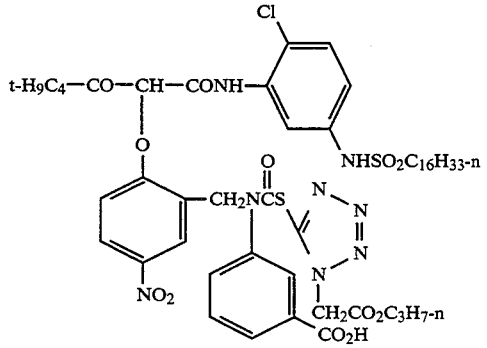

D6

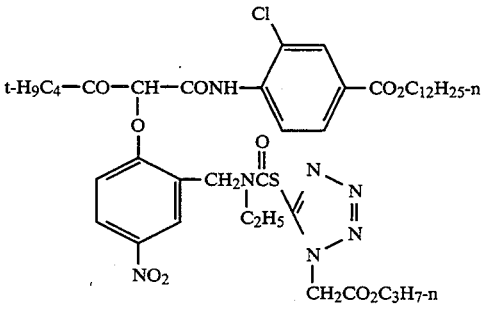

-continued
D7
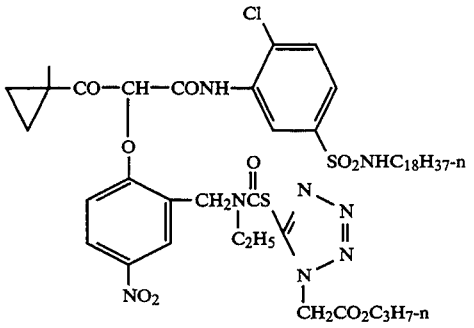
D8
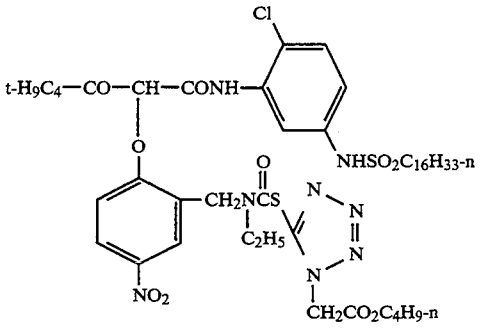
D9
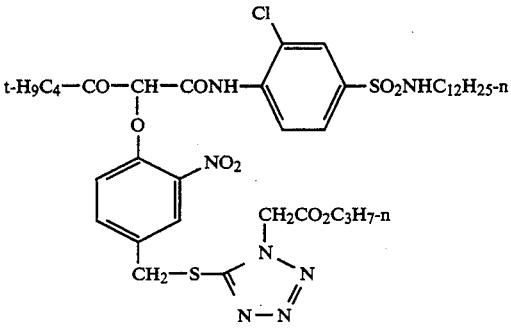
D10
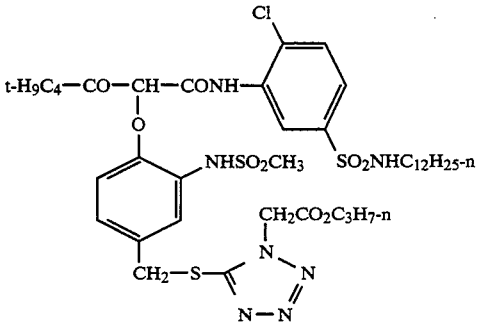
D11
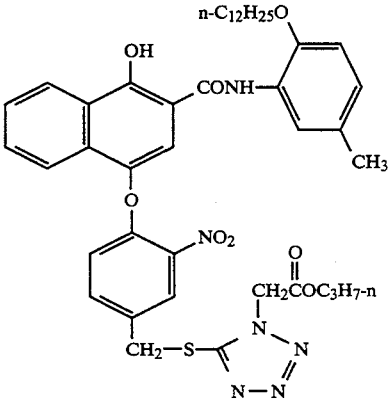
D12
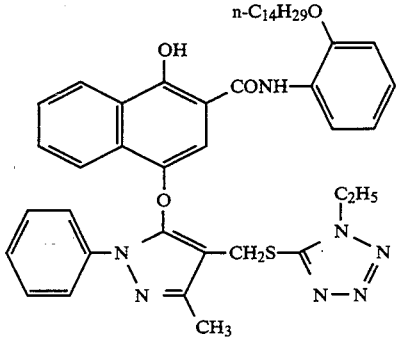
D13
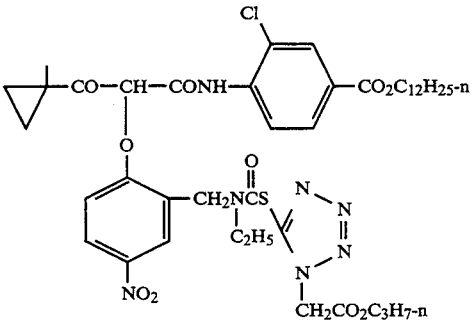
D14
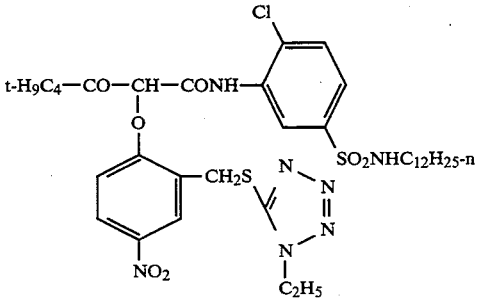

-continued
D15
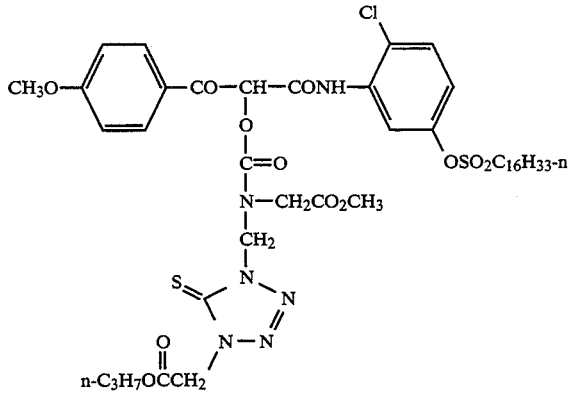
D16
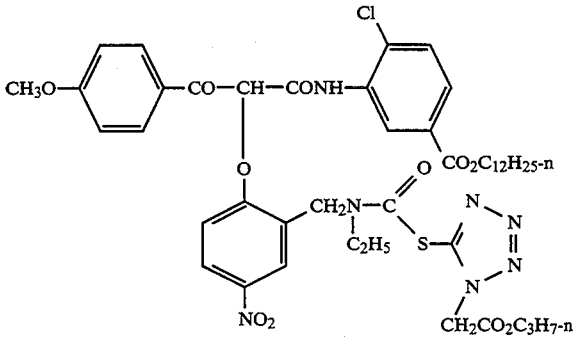
D17
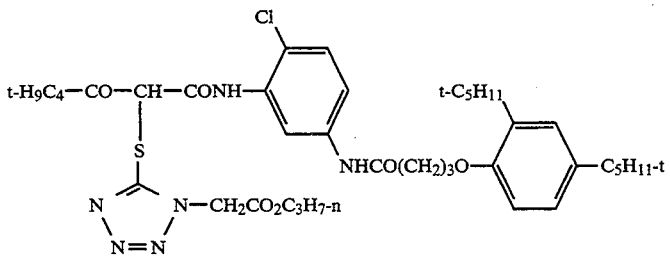
D18
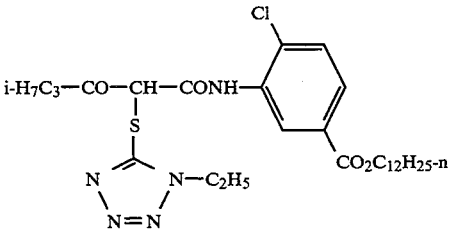
D19
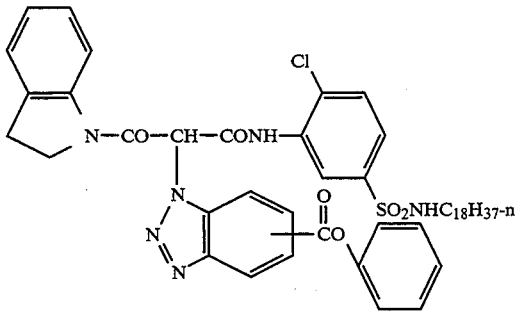
(ISO)
D20
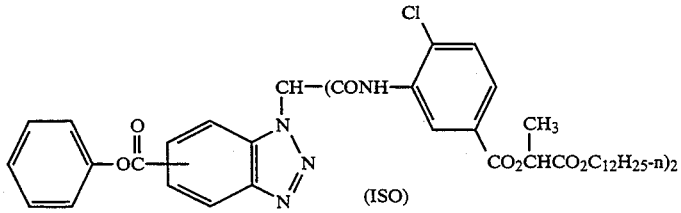
(ISO)

-continued

D21

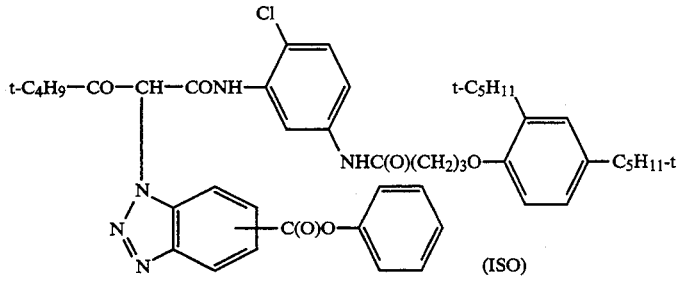

D22

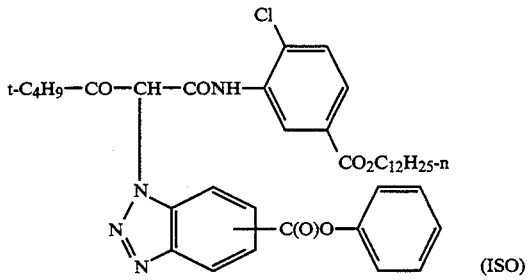

D23

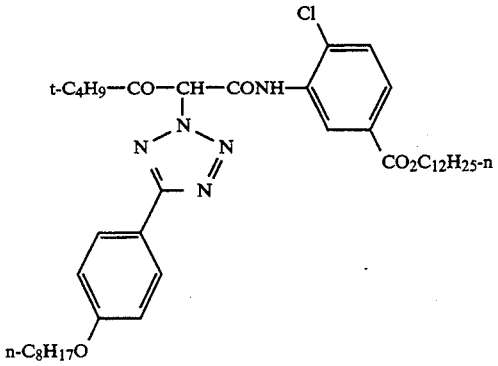

D24

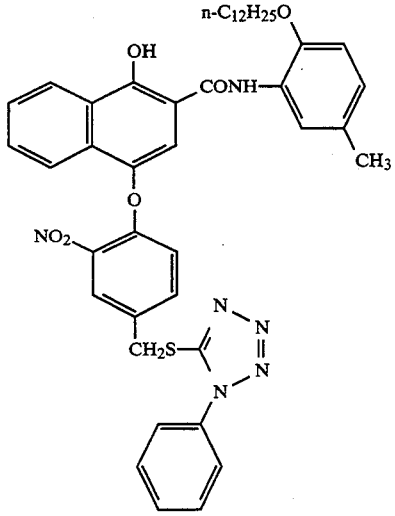

Useful coated levels of the acylacetanilide yellow dye-forming imaging couplers with oxazolidine-2,4-dione coupling-off groups of this invention range from about 0.05 to about 3.0 g/sq m, or more typically from 0.10 to 2.0 g/sq/m. Useful coated levels of the DIR couplers of this invention range from about 0.01 to about 1.00 g/sq m, or more typically from 0.02 to 0.50 g/sq m. Useful coated mole ratios of the acylacetanilide yellow dye-forming imaging couplers of this invention to the DIR couplers range from about 0.01 to about 1:2, or more typically from about 0.03 to about 1:1.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanilide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred.

It is advantageous that the invention provides a photographic element in which the yellow dye-forming coupler has high reactivity and forms dyes efficiently when used in combination with DIR couplers. The element maintains high blue gamma or contrast in one or more yellow dye-forming layers while effectively reducing gamma in adjacent layers as a function of blue exposure. Further, the element yields a dye of the proper hue which has good stability, especially good stability toward heat.

For optimum intralayer and interlayer effectiveness it is desirable that the reactivities of an imaging coupler and the associated DIR be properly balanced. As used herein associated means that the imaging coupler and DIR coupler are coated either in the same layer or in an adjacent layer having the same spectral sensitivity or in an interlayer adjacent to the layer containing the yellow dye-forming coupler. If the imaging coupler is too inactive relative to the DIR coupler, all of the DIR coupler is used up at low exposures. If the imaging coupler is too active relative to the DIR coupler, the DIR coupler cannot compete effectively for oxidized developer and thus the inhibitor is not released efficiently.

As will be discussed in the Examples, combinations of yellow dye-forming couplers and DIR couplers are desired that maintain suitable gamma in the yellow image dye-forming layer (referred to as the causer layer) while effectively reducing gamma in layers of different spectral sensitivity (referred to as receiver layers), particularly green-light sensitive magenta dye-forming layers. Thus, it is desirable to identify yellow dye-forming imaging couplers that may be combined in reactive association with DIR couplers such that the coupler activities are balanced and such that high intralayer gamma is maintained while interlayer inhibition causes the gamma in one or more receiver layers to be efficiently reduced. Furthermore it is desirable that the yellow dye-forming imaging coupler/DIR combinations yield dyes having the proper hue and good stability.

The materials of the invention can be used in any of the ways and in any of the combinations known in the art. Typically, the invention materials are incorporated in a silver halide emulsion and the emulsion coated as a layer on a support to form part of a photographic element.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3- position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl (3-chloro-4-((3-(2-chloro-4-((1-tridecanoylethoxy) carbonyl-)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis (1,1-dimethylpropyl)phenoxy)-1-oxobutyl-)amino)-N-(4,5-dihydro-5-oxo-1-(2,4,6-trichlorophenyl) -1H-pyrazol-3-yl)-, "Coupler 5": Benzamide, 3-( (2-(2,4-bis (1,1-dimethylpropyl)-phenoxy) -1-oxobutyl)amino) -N-(4', 5'-dihydro-5'-oxo-1'-(2,4,6-trichlorophenyl) (1,4'-bi-1H-pyrazol) -3'-yl)-, "Coupler 6": Carbamic acid, (6-(((3-(dodecyloxy)propyl)amino)carbonyl) -5-hydroxy-1-naphthalenyl)-, 2-methylpropyl ester , "Coupler 7": Acetic acid, ((2-((3-(((3-(dodecyloxy)propyl-)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl)azo)-5-oxo-1-(2,4,6- trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N- [1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl) -, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)-carbonyl)-4-hydroxy-1-naphthalenyl) oxy)ethoxy)-phenyl)azo)-4-hydroxy-, disodium salt; and a slow cyan layer containing Couplers 2 and 6;

(7) an undercoat layer containing Coupler 8; and (8) an antihalation layer.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1 H-pyrazol-3-yl)-; and "Coupler 5": Benzamide, 3-(((2,4-bis(1,1-dimethylpropyl)-phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing"Coupler 7": Butanamide, N-(4-((2-(2,4bis(1,1-dimethylpropyl)phenoxy)-1-oxobutyl-)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

"Development Inhibitor-Releasing" compounds (DIR's) useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952 ,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above.

The element of the invention is suitably used with a bromoiodide silver halide emulsion. Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T = ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(β-(methanesulfonamido) ethyl)aniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any substituent that does not harm the photographic properties of the element. Usually the further substituent will have less than 30 carbon atoms and typically less than 20 carbon atoms.

Synthesis of the yellow dye-forming coupler of the invention is well-known in the art. They may be made, for example, by condensing a suitably substituted aniline with methyl pivaloyl acetate (MPA) in a high boiling point solvent such as n-heptane during which methanol is removed azeotropically. In the case of I3, for example, 4-nitro-3-chlorobenzoic acid is esterified with n-hexadecanol. Then the nitro group of the resulting intermediate is reduced to give the aniline needed for the condensation with MPA.

The coupling-off group is attached to the 4-equivalent parent coupler by the intermediacy of a chloro derivative which is obtained by treating the parent coupler with a suitable chlorinating agent such as sulfuryl chloride. The chloro substituent is then displaced by the anion of the coupling-off group. This conversion can be undertaken in a polar solvent such as acetonitrile using an organic base such as triethylamine to ionize the coupling-off group. U.S. Pat. No. 4,022,620 discloses this methodology and is incorporated herein by reference.

The acylacetanilide yellow dye-forming imaging coupler and DIR coupler combinations of this invention may be used together with a variety of other types of couplers in the same layer or in different layers of a multilayer photographic material. Specifically contemplated is the use of the acylacetanilide yellow dye-forming imaging coupler and DIR coupler combinations of this invention together with one or more benzoylacetanilide yellow dye-forming imaging couplers, such as those described in U.S. Pat. Nos. 3,973,968 or 4,022,620 in the same layer or in an adjacent layer. Also specifically contemplated is the use of the acylacetanilide yellow dye-forming coupler and DIR coupler combinations of this invention in one or more blue sensitive layers together with one or more green sensitive layers containing at least one two-equivalent 1-phenyl-3-anilino-5-pyrazolone magenta dye-forming coupler.

EXAMPLE 1

Comparative Evaluation of Coupler plus Development Inhibitor Releasing Coupler Combinations of this Invention To illustrate the advantages of the inventive acylacetanilide coupler/DIR coupler combinations, the simple multilayer test format shown below was utilized. The test film includes a so-called causer layer containing acylacetanilide imaging coupler/DIR coupler combinations of this invention and a silver bromoiodide emulsion, an interlayer with a scavenger for oxidized developer and a receiver layer with a magenta dye-forming coupler and a silver bromoiodide emulsion. As will be elaborated subsequently, measurement of the ratio of blue:green gamma following exposure and processing provides an indication of the effectiveness of the combinations of couplers used in the causer layer.

| Multilayer Test Film Structure | |
|---|---|
| Gel Overcoat: | Gelatin @ 1.50 g/sq m<br>Bis(vinylsulfonyl)methane hardener @ 0.054 g/sq m |
| Causer Layer: | Acylacetanilide Yellow Dye-Forming Imaging Coupler @ 0.00147 mol/sq m<br>DIR Coupler D1 @ 0.247 g/sq m.<br>0.79 μm Silver Bromoiodide Emulsion (3% Iodide) @ 0.81 g Ag/sq m<br>Gelatin @ 1.60 g/sq m |
| Interlayer: | Oxidized Developer Scavenger A1 @ 0.171 g/sq m<br>Silver @ 0.058 g/sq m<br>Gelatin @ 2.20 g/sq m<br>Bis(vinylsulfonyl)methane hardener @ 0.076 g/sq m |
| Receiver Layer: | Magenta Dye-Forming Coupler A2 @ 0.86 g/sq m<br>0.46 μm Silver Bromoiodide Emulsion (6.4% Iodide) @ 1.08 g Ag/sq m<br>Gelatin @ 1.60 g/sq m |
| Antihalation Layer: | Grey silver @ 0.30 g/sq m<br>Gelatin @ 2.40 g/sq m |
| Transparent Support: | Cellulose Acetate |

Structural formulas for A1 and A2 in the above coating diagram and for comparison couplers C1–C5 are given below.

A-1

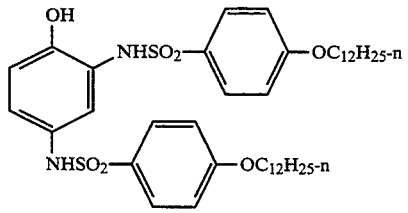

-continued

A2

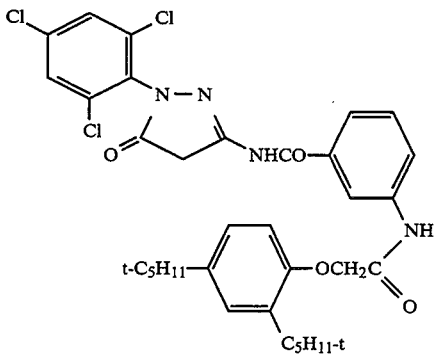

C1

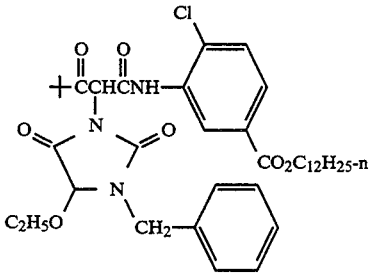

C2

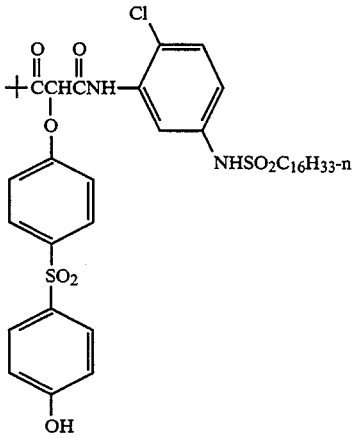

C3

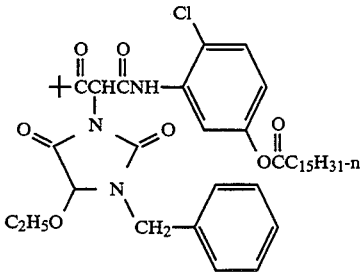

C4

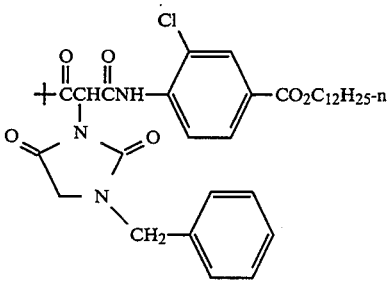

-continued

C5

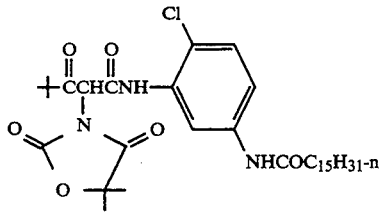

Aqueous dispersions of the couplers were prepared by methods known in the art. The acylacetanilide yellow-dye forming imaging coupler dispersions contained 6% by weight of gelatin, 9% by weight of coupler and a 1:0.5:1.5 weight ratio of coupler to di-n-butyl phthalate coupler solvent to cyclohexanone auxiliary solvent. The auxiliary solvent was included to aid in dispersion preparation and was removed by washing the dispersion for 6 hr at 4° C. and pH 6 prior to coating. The dispersion of DIR coupler D1 was prepared with 7% by weight of gelatin, 6% by weight of coupler and a 1:1:2 weight ratio of D1 to di-n-butyl phthalate to 2-(2-butoxyethoxy) ethyl acetate auxiliary solvent. The auxiliary solvent was removed by washing for 6 hr at 4C and pH 6. The dispersion of coupler A2 was prepared with 6% by weight of gelatin, 8.8% by weight of coupler and a 1:0.5:1.5 weight ratio of coupler to tricresyl phosphate coupler solvent to 2-(2-butoxyethoxy) ethyl acetate. The latter was removed by washing for 6 hr at 4° C. and pH 6 prior to coating.

The coatings were slit into 30 cm×35 mm strips. After hardening the strips were exposed through a 0–4 neutral density step wedge (0.2 density increments), Daylight V and Wratten 2B filters. The exposed strips were than processed through a standard C-41 process using the following processing times:

| | |
|---|---|
| Developer | 2.5 min |
| Bleach | 4.0 min |
| Wash | 2.0 min |
| Fix | 4.0 min |
| Wash | 2.0 min |

For each processed strip, Status M blue and green densities were measured as a function of exposure. Values for Status M blue gamma or contrast (Blue Gamma) and Status M green gamma or contrast (Green Gamma) were obtained from the slopes of plots of density vs log exposure. Values for Blue Gamma and Green Gamma are listed in Table I. When both the causer and the receiver layers are exposed and developed, a film with a desirable combination of yellow dye-forming imaging coupler and DIR coupler will yield a high blue gamma and a substantial reduction in green gamma (due to the interlayer interimage effect resulting from diffusion of the released inhibitor into the magenta dye-forming layer). An active DIR coupler is required in the causer layer to efficiently reduce green gamma in the receiver layer, and an active yellow dye-forming imaging coupler is also required in the causer layer to maintain efficient dye formation and suitably high blue gamma even with efficient inhibitor release. The ratio of Blue Gamma to Green Gamma (Gamma Ratio) is also listed in Table I and serves as a measure of the effectiveness of the combination of yellow dye-forming imaging coupler and DIR coupler. The higher the Gamma Ratio the better.

TABLE I

| Acylacetanilide Imaging Coupler Coated in Causer Layer with D1 | Blue Gamma | Green Gamma | Gamma Ratio |
|---|---|---|---|
| A) C1 Comparative Coupler | 0.59 | 0.57 | 1.04 |
| B) C2 Comparative Coupler | 0.73 | 0.64 | 1.14 |
| C) C3 Comparative Coupler | 0.65 | 0.63 | 1.03 |
| D) C4 Comparative Coupler | 0.59 | 0.51 | 1.16 |
| E) C5 Comparative Coupler | 0.34 | 0.47 | 0.72 |
| F) I1 Invention | 0.60 | 0.46 | 1.30 |
| G) I2 Invention | 0.73 | 0.43 | 1.70 |
| H) I3 Invention | 0.55 | 0.45 | 1.22 |
| I) I4 Invention | 0.61 | 0.52 | 1.17 |
| J) I5 Invention | 0.61 | 0.31 | 1.97 |
| K) I6 Invention | 0.73 | 0.46 | 1.59 |

It is evident from the data in Table I that all of the acylacetanilide imaging coupler/DIR coupler combinations of this invention yield desired increases in the ratio of blue gamma to green gamma relative to the comparative acylacetanilide imaging coupler/DIR coupler combinations. It is particularly noteworthy that couplers I1 and I4 of this invention yield higher Gamma Ratios in combination with D1 than does coupler C1, which uses the same coupler parent (same R3) but a different coupling-off group. Likewise coupler I5 of this invention yields a higher Gamma Ratio in combination with D1 than does comparative coupler C4, even though both couplers are derived from the same parent (same R3). While coupler C5 contains an oxazolidine-2,4-dione coupling-off group, it does not contain an R3 substituent within the scope of this invention. Comparison of the Gamma Ratio values obtained when the couplers of this invention are combined with D1 with the Gamma Ratio of C5 plus D1 illustrates that not all couplers with oxazolidine-2,4-dione coupling-off groups show the advantages of the couplers of this invention in combination with DIR couplers. The hues of the dyes provided by the acylacetanilide yellow-dye forming imaging couplers of this invention were found to be suitable and the dye stabilities were found to be excellent.

EXAMPLE 2

Comparative Evaluation of Coupler Combination of this Invention in a Multilayer Color Negative Film The advantages of the novel acylacetanilide imaging coupler/DIR coupler combinations of this invention are further illustrated by comparative data for the product-type multilayer color negative films described below. The multilayer film structure is as shown in the table. Dispersions of the various components were prepared and coated according to procedures known in the art. Component laydowns in g/sq m are listed in parentheses. In the table, the solid lines mark the boundaries between layers. Structural formulas of coated components not given previously are provided immediately after the table.

| Multilayer Structure for Example 2 | |
|---|---|
| 1 Overcoat Layer: | Matte Beads<br>UV Absorber UV-1 (0.111) & S-1 (0.111)<br>UV Absorber UV-2 (0.111) & S-1 (0.111) |

-continued

| Multilayer Structure for Example 2 | |
|---|---|
| | CD-1 Cyan Dye (0.0067) & S-2 (0.0268) |
| | Silver Bromide Lippmann Emulsion (0.215 Ag) |
| | Gelatin (1.08) |
| | Bis(vinylsulfonyl)methane Hardener (at 2% by weight of total Gelatin). |
| 2 Fast Yellow Layer: | D1 (0.0452) (DIR) & S-2 (0.0452) |
| | B-1 (0.0053) BAR Coupler & S-3 (0.0053) |
| | CC1 (0.0201) & S-2 (0.0201) |
| plus) | C1 (0.473) (0.68 mmole/sq m) (Comparison) & S-2 (0.473) |
| or) | I1 (0.235) (0.40 mmole/sq m) (Invention) & S-2 (0.235) |
| or) | I2 (0.269) (0.39 mmole/sq m) (Invention) & S-2 (0.269) |
| or) | I3 (0.270) (0.42 mmole/sq m) (Invention) & S-2 (0.270) |
| | Silver Bromoiodide Emulsion (0.570 Ag), 9 mole % Iodide (1.0 μm) |
| | Silver Bromoiodide Emulsion (0.226 Ag), 4 mole % Iodide T-Grain (3.0 × 0.14 μm) |
| | Gelatin (1.97) |
| 3 Slow Yellow Layer: | D1 (0.0646) & S-2 (0.0646) |
| | B-1 (0.0029) & S-3 (0.0029) |
| | CC1 (0.0161) & S-2 (0.0161) |
| plus) | C1 (1.399) (2.01 mmole/sq m) (Comparison) & S-2 (1.399) |
| or) | I1 (0.829) (1.40 mmole/sq m) (Invention) & S-2 (0.829) |
| or) | I2 (0.861) (1.26 mmole/sq m) (Invention) & S-2 (0.861) |
| or) | I3 (0.908) (1.40 mmole/sq m) (Invention) & S-2 (0.908) |
| | Silver Bromoiodide Emulsion (0.635 Ag), 6 mole % Iodide T-Grain (1.0 × 0.26 μm) |
| | Silver Bromoiodide Emulsion (0.247 Ag), 1.3 mole % Iodide T-Grain (0.55 × 0.08 μm) |
| | Gelatin (2.60) |
| 4 Interlayer: | YD-2 Filter Dye (0.108) |
| | Gelatin (1.29) |
| 5 Fast Magenta Layer: | M-1 (0.0646) Magenta Dye-Forming Coupler & S-4 (0.0517) & ST-1 (0.0125) Addendum |
| | MM-1 (0.0538) Masking Coupler & S-4 (0.108) |
| | IR-3 (0.0108) DIR & S-4 (0.0216) |
| | IR-4 (0.0108) DIR & S-2 (0.0108) |
| | Silver Bromoiodide Emulsion (0.968 Ag), 4 mole % Iodide T-Grain (2.16 × 0.12 μm) |
| | Gelatin (1.33) |
| 6 Mid Magenta Layer: | M-1 (0.0807) & S-4 (0.0646) & ST-1 (0.0161) |
| | MM-1 (0.0646) & S-4 (0.129) |
| | IR-1 (0.0236) DIR & S-5 (0.0572) |
| | Silver Bromoiodide Emulsion (0.968 Ag), 4 mole % Iodide T-Grain (1.25 × 0.12 μm) |
| | Gelatin (1.48) |
| 7 Slow Magenta Layer: | M-1 (0.258) & S-4 (0.206) & ST-1 (0.0516) |
| | MM-1 (0.0646) & S-4 (0.129) |
| | Silver Bromoiodide Emulsion (0.538 Ag), 1.3 mole % Iodide T-Grain (0.55 × 0.08 μm) |
| | Silver Bromoiodide Emulsion (0.280 Ag), 4 mole % Iodide T-Grain (1.00 × 0.09 μm) |
| | Gelatin (1.78) |
| 8 Interlayer: | YD-1 (0.075) Yellow Dye |
| | Gelatin (1.29) |
| 9 Fast Cyan Layer: | CC-1 (0.124) Cyan Dye-Forming Coupler & S-2 (0.124) |
| | CM-1 (0.0323) Masking Coupler |
| | IR-1 (0.0237) DIR & S-5 (0.0437) |
| | IR-2 (0.0484) DIR & S-4 (0.194) |
| | Silver Bromoiodide Emulsion (1.08 Ag), 4 mole % Iodide T-Grain (2.6 × 0.13 μm) |
| | Gelatin (1.36) |
| 10 Mid Cyan Layer: | CC-1 (0.226) & S-2 (0.226) |
| | CM-1 (0.0215) |
| | IR-1 (0.0108) & S-5 (0.216) |
| | Silver Bromoiodide Emulsion (0.699 Ag), 4 mole % Iodide T-Grain (1.3 × 0.12 μm) |
| | Gelatin (1.66) |
| 11 Slow Cyan Layer: | CC-1 (0.538) & S-2 (0.538) |
| | CM-1 (0.0323) |
| | B-1 (0.0377) & S-3 (0.0377) |
| | Silver Bromoiodide Emulsion (0.473 Ag), 1.3 mole % Iodide T-Grain (0.55 × 0.08 μm) |
| | Silver Bromoiodide Emulsion (0.463 Ag), 4 mole % Iodide T-Grain (1.00 × 0.09 μm) |
| | Gelatin (1.83) |
| 12 Antihalation Layer: | Grey Silver (0.22 Ag) |
| | Gelatin (2.44) |
| Cellulose Triacetate Support | |

S-1
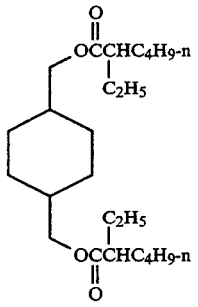
S-2
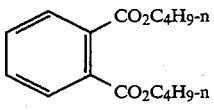
S-3
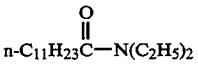
S-4
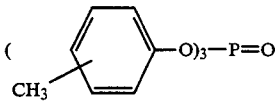
mixed isomers
S-5
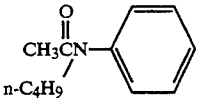
UV-1
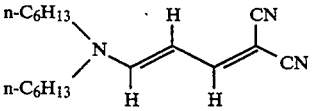
UV-2
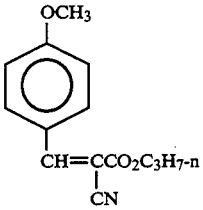
CD-1
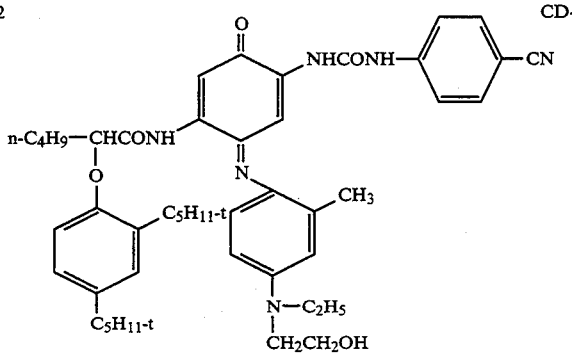
B-1
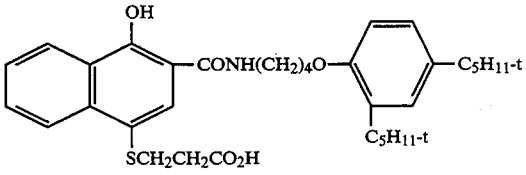
YD-2
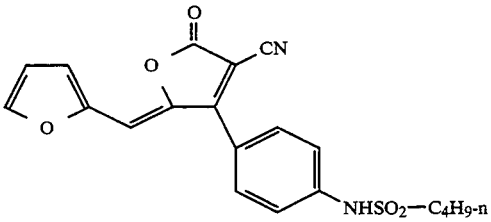
M-1
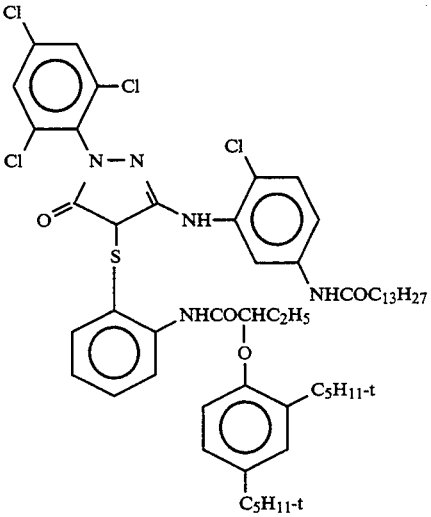
ST-1
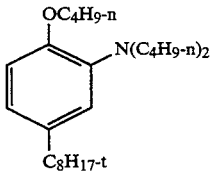

-continued
IR-3
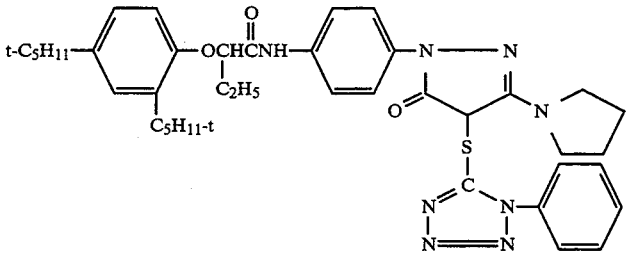
CC-1
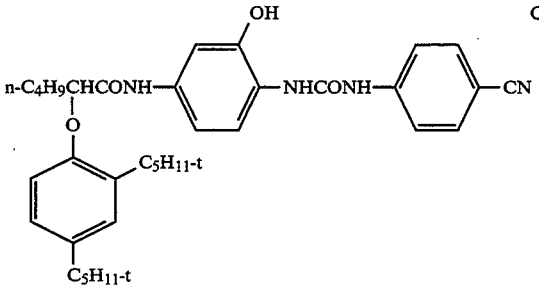
IR-4 (D20)
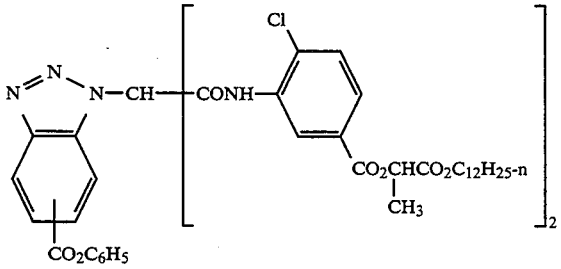
CM-1
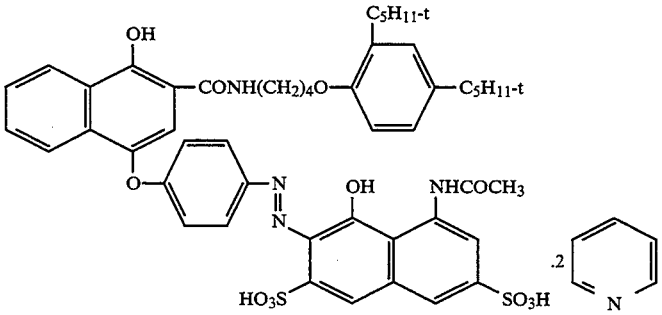
MM-1
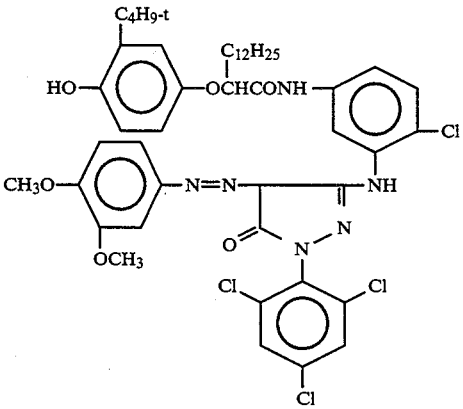
YD-1
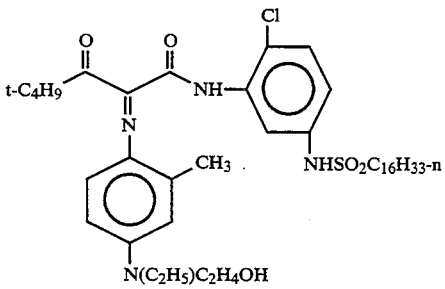

-continued

IR-1

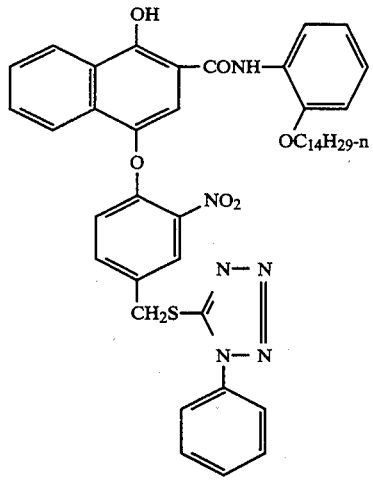

IR-2

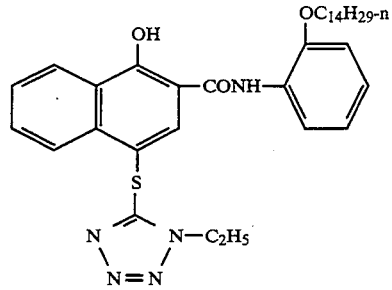

As indicated in the table, film sample A contains comparative yellow dye-forming imaging coupler C1 along with DIR coupler D1 in layers 2 and 3, whereas film samples B, C and D contain inventive acylacetanilide yellow dye-forming couplers, I1, I2 and I3, respectively, together with DIR coupler D1. Because the couplers of this invention are more active and yield more yellow dye than comparative coupler C1, the latter could all be coated at lower laydowns both on a weight basis and on a molar basis, as is indicated by the lower levels in the table. The lower coverages permitted by the coupler combinations of this invention can provide substantial advantages in terms of lower cost, layer thinning and improved sharpness.

After hardening, samples of all four films in the table were given a neutral stepwise exposure and processed in a standard KODAK FLEXICOLOR C-41 color negative process. Status M densities were measured for each step of the processed film samples and plotted vs the log of exposure. Gamma values were obtained from the slopes of the straight line portions of these plots in the midscale exposure region. Blue and green gamma values (Blue Gamma & Green Gamma, respectively) are compared in Table II. As noted above, a high Blue Gamma relative to Green Gamma is desirable, since it indicates efficient dye formation in the blue layers and efficient onto-green interimage. As is evident from the data in Table II, all of the couplers I1–I3 of this invention provide significant increases in Blue Gamma, in spite of being coated at lower levels and lower molar laydowns. In addition couplers I1 and I3 yield desirable reductions in Green Gamma, and I1, I2 and I3 all yield substantial increases in the ratio of Blue Gamma to Green Gamma. This allows desirable increases in onto-green interimage with the coupler plus DIR combinations of this invention.

TABLE II

| Multilayer Film | Midscale Blue Gamma | Midscale Green Gamma | Ratio Blue/Green |
|---|---|---|---|
| A) C1 plus D1 (Comparison) | 0.726 | 0.545 | 1.33 |
| B) I1 plus D1 (Invention) | 0.803 | 0.534 | 1.50 |
| C) I2 plus D1 (Invention) | 0.833 | 0.545 | 1.53 |
| D) I3 plus D1 (invention) | 0.756 | 0.527 | 1.43 |

Excellent multilayer performance is also obtained if coupler I3 is dispersed at either 1:1 or 0.5 weight ratio with coupler solvents S4, di-n-butyl sebecate, or N,N-di-n-butyl dodecanamide.

EXAMPLE 3

Multilayer Film Utilizing Imaging Coupler I3 in Combination with DIR Couplers D21 or D22

The following multilayer films containing yellow dye-forming imaging coupler I3 in combination with yellow dye-forming DIR coupler D21 (A) or D22 (B) also represent preferred embodiments of this invention.

| Multilayer Structure of Example 3 | | |
|---|---|---|
| 1. Overcoat Layer: | | Matte Beads |
| | | UV Absorber UV-1 (0.111) & S-1 (0.111) |
| | | UV Absorber UV-2 (0.111) & S-1 (0.111) |
| | | CD-1 Cyan Dye (0.0067) & S-2 (0.0268) |
| | | Silver Bromide Lippmann Emulsion (0.215 Ag) |
| | | Gelatin (1.08) |
| | | Bis(vinylsulfonyl)methane Hardener (at 2% by weight of total Gelatin). |
| 2. Fast Yellow Layer: | with A | D21 (0.0484) (DIR) & S-2 (0.0484) |
| | or B | D22 (0.0484) (DIR) & S-2 (0.0484) |
| | | B-1 (0.0053) BAR Coupler & S-3 (0.0053) |
| | | CC-1 (0.0162) & S-2 (0.0162) |
| | | I3 (0.269) (0.42 mmole/sq m) (Invention) & S-2 (0.269) |
| | | Silver Bromoiodide Emulsion (0.570 Ag), 9 mole % Iodide (1.0 μm) |
| | | Silver Bromoiodide Emulsion (0.226 Ag), 4 mole % Iodide T-Grain (3.0 × 0.14 μm) |
| | | Gelatin |

-continued

| Multilayer Structure of Example 3 | |
|---|---|
| 3. Slow Yellow Layer: | with A D21 (0.0646) & S-2 (0.0646) |
| | or B D22 (0.646) & S-2 (0.0646) |
| | B-1 (0.0029) & S-2 (0.0029) |
| | CC-1 (0.0161) & S-2 (0.0161) |
| | I3 (0.915) (Invention) & S-2 (0.915) |
| | Silver Bromoiodide Emulsion (0.635 Ag), 6 mole % |
| | Iodide T-Grain (1.0 × 0.26 μm) |
| | Silver Bromoiodide Emulsion (0.247 Ag), 1.3 mole % |
| | Iodide T-Grain (0.55 × 0.08 μm) |
| | Gelatin (2.60) |
| 4. Interlayer: | YD-2 Filter Dye (0.108) |
| | Gelatin (1.29) |
| 5. Fast Magenta Layer: | M-1 (0.0624) Magenta Dye-Forming Coupler & S-4 (0.0499) & ST-1 (0.0125) Addendum |
| | MM-1 (0.0538) Masking Coupler & S-4 (0.108) |
| | IR-3 (0.0108) DIR & S-4 (0.0216) |
| | IR-4 (0.0108) DIR & S-2 (0.0108) |
| | Silver Bromoiodide Emulsion (0.968 Ag), 4 mole % |
| | Iodide T-Grain (2.16 × 0.12 μm) |
| | Gelatin (1.33) |
| 6. Mid Magenta Layer: | M-1 (0.0807) & S-4 (0.0646) & ST-1 (0.0161) |
| | MM-1 (0.0646) & S4 (0.129) |
| | IR-1 (0.0236) DIAR & S-5 (0.0572) |
| | Silver Bromoiodide Emulsion (0.968 Ag), 4 mole % |
| | Iodide T-Grain (1.25 × 0.12 μm) |
| | Gelatin (1.48) |
| 7. Slow Magenta Layer: | M-1 (0.258) & S-4 (0.206) & ST-1 (0.516) |
| | MM-1 (0.0646) & S-4 (0.129) |
| | Silver Bromoiodide Emulsion (0.538 Ag), 1.3 mole % |
| | Iodide T-Grain (0.55 × 0.08 μm) |
| | Silver Bromoiodide Emulsion (0.280 Ag), 4 mole % |
| | Iodide T-Grain (1.00 × 0.09 μm) |
| | Gelatin (1.78) |
| 8. Interlayer: | YD-1 (0.075) Yellow Dye |
| | Gelatin (1.29) |
| 9. Fast Cyan Layer: | CC-1 (0.140) Cyan Dye-Forming Coupler & S-2 (0.140) |
| | CM-1 (0.0323) Masking Coupler |
| | IR-1 (0.0204) DIAR & S-5 (0.0408) |
| | IR-2 (0.0484) DIR & S-4 (0.194) |
| | Silver Bromoiodide Emulsion (1.08 Ag), 4 mole % |
| | Iodide T-Grain (2.6 × 0.13 μm) |
| | Gelatin (1.36) |
| 10. Mid Cyan Layer: | CC-1 (0.226) & S-2 (0.226) |
| | CM-1 (0.0215) |
| | IR-1 (0.0108) & S-5 (0.216) |
| | Silver Bromoiodide Emulsion (0.699 Ag), 4 mole % |
| | Iodide T-Grain (1.3 × 0.12 μm) |
| | Gelatin (1.66) |
| 11. Slow Cyan Layer: | CC-1 (0.538) & S-2 (0.538) |
| | CM-1 (0.0269) |
| | B-1 (0.0377) & S-3 (0.0377) |
| | Silver Bromoiodide Emulsion (0.409 Ag), 1.3 mole % |
| | Iodide T-Grain (0.55 × 0.08 μm) |
| | Silver Bromoiodide Emulsion (0.441 Ag), 4 mole % |
| | Iodide T-Grain (1.00 × 0.09 μm) |
| | Gelatin (1.83) |
| 12. Antihalation Layer: | Grey Silver (0.22 Ag) |
| | Gelatin (2.44) |
| Cellulose Triacetate Support | |

The multilayer films having the structures noted above were exposed and processed as in Example 2. Both films A and B gave the desired blue, green and red gamma values and provided good acutance, good color reproduction and good dye stability.

The preceding examples are set forth to illustrate specific embodiments of this invention and are not intended to limit the scope of the materials or combinations of this invention. Additional embodiments and advantages within the scope of the claimed invention will be apparent to one skilled in the art.

What is claimed is:

1. A photographic element comprising a support bearing a blue light sensitive silver halide emulsion layer containing an acylacetanilide yellow image dye-forming coupler having formula I:

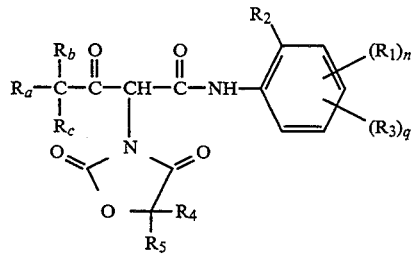

I wherein:

$R_a$ is an alkyl, alkoxy, or aryloxy group;

$R_b$ is an alkyl or aryl group;

$R_c$ is hydrogen or an alkyl group;

$R_1$ is a substituent;

$R_2$ is selected from the group consisting of halogen, trifluoromethyl, alkoxy and aryloxy;

each $R_3$ is bonded at the 4- or 5- position relative to the anilino nitrogen and is independently a substituent selected from the group consisting of halogen, alkoxycarbonyl (—$CO_2R$), carbamoyl (—CONRR'), sulfonate (—$OSO_2R$), sulfamoyl (—$SO_2NRR'$), sulfonyl (—$SO_2R$), trifluoromethyl, cyano, and sulfonamido (—$NRSO_2R'$), in which each R and R' is independently hydrogen or a substituent;

q is 1 or 2;

n is an integer from 0 to (3−q);

$R_4$ and $R_5$ are independently hydrogen or an alkyl group; and provided that each substituent for $R_a$, $R_b$, $R_c$, $R_1$, $R_2$, $R_3$, $R_4$, and $R_5$ having a substitutable hydrogen may be substituted with a substituent selected from the group consisting of halogen, nitro; hydroxyl; cyano; and carboxyl; alkyl; alkenyl; alkoxy; aryl; aryloxy; carbonamido; sulfonamido; sulfamoyl; carbamoyl; acyl; sulfonyl; sulfonyloxy; sulfinyl; thio; acyloxy; amine; imino; phosphate; phosphate; heterocyclic group, heterocyclic oxy group, or heterocyclic thio group each of which may be substituted and which contain a 3 to 7 membered heterocyclic ring composed of carbon atoms and at least one hetero atom selected from the group consisting of oxygen, nitrogen and sulfur; quaternary ammonium; and silyloxy, where said substituents may themselves be suitably substituted with any of the above groups;

wherein the blue light sensitive silver halide emulsion layer has associated therewith a development inhibitor releasing coupler.

2. The photographic element of claim 1 wherein $R_a$, $R_b$, and $R_c$ are independently selected alkyl groups.

3. The photographic element of claim 2 wherein $R_a$, $R_b$, and $R_c$ are each a methyl group.

4. The photographic element of claim 2, wherein at least one of $R_4$ and $R_5$ is an alkyl group.

5. The photographic element of claim 1 wherein at least one of $R_4$ and $R_5$ is an alkyl group.

6. The photographic element of claim 5 wherein $R_4$ and $R_5$ are methyl groups.

7. The photographic element of claim 1 wherein $R_2$ is chlorine and $R_3$ is a an alkoxycarbonyl group in the 4- or 5- position.

8. The photographic element of claim 1, wherein $R_a$, $R_b$, $R_c$, $R_1$, $R_2$, $R_3$, $R_4$ and $R_5$ taken together have at least 12 carbon atoms.

9. The photographic element of claim 1 wherein $R_a$, $R_b$, $R_c$, $R_1$, $R_2$ and $R_3$ taken together have at least carbon atoms.

10. The photographic element of claim 1, wherein the coated level of coupler I is in the range of 0.05 to 3.0 g/sq.m.

11. The photographic element of claim 2, wherein $R_2$ is chlorine and $R_3$ is an alkoxycarbonyl group in the 4- or 5- position.

12. The photographic element of claim 1, wherein the acylacetanilide yellow dye-forming imaging coupler is selected from the group consisting of

I1

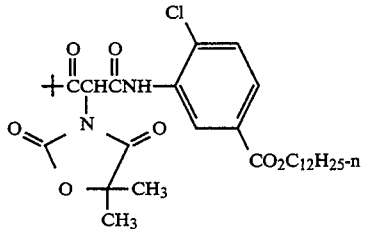

I2

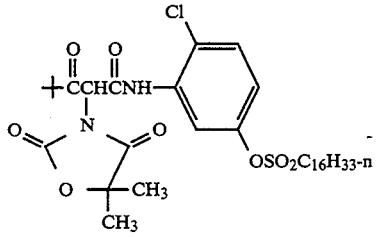

I3

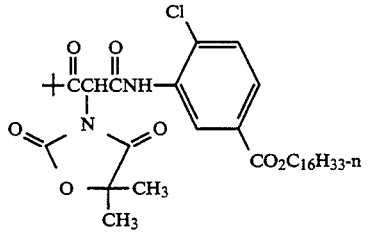

I4

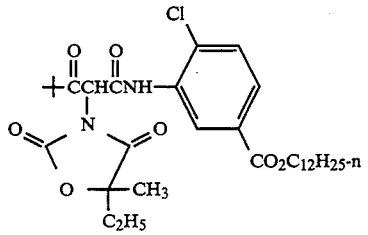

I5

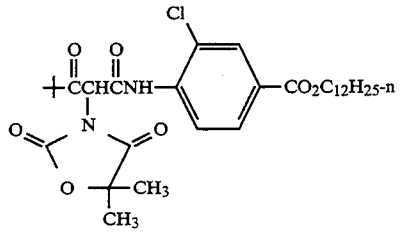

I6

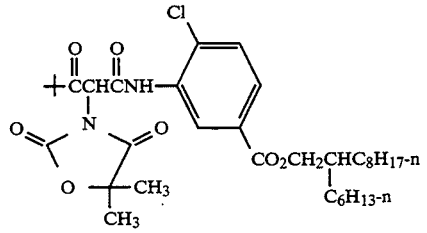

I7

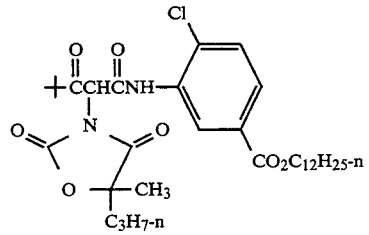

-continued
I8
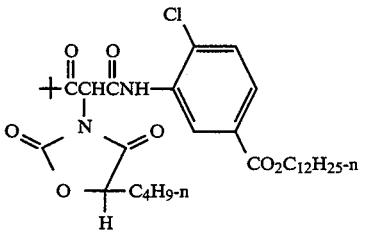
I9
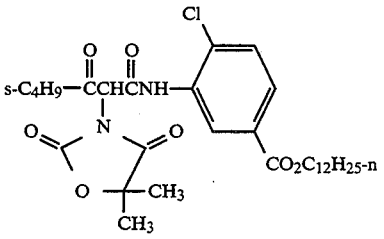
I10
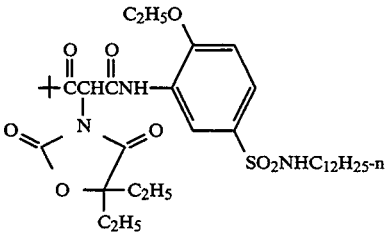
I11
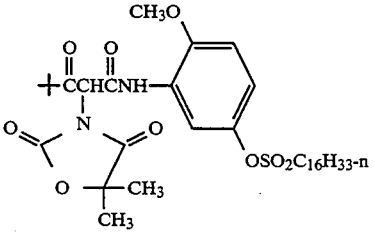
I12
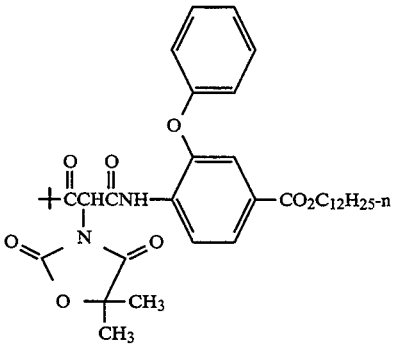
I13
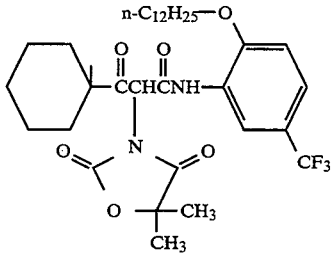
-continued
I14
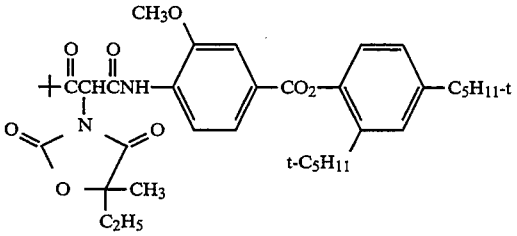
I15
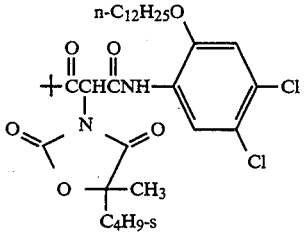
I16
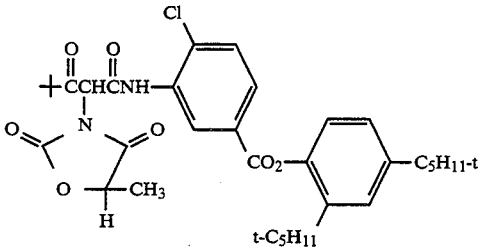
I17
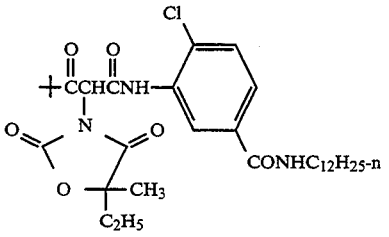
I18
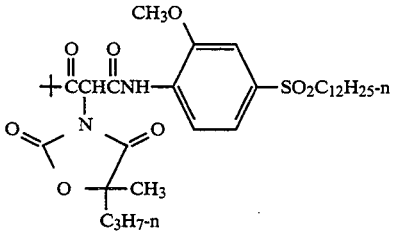
I19
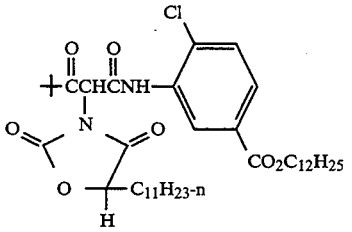
and -continued

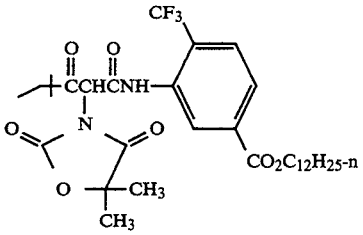

13. The photographic element of claim 1 wherein the DIR coupler is a yellow dye-forming coupler.

14. The element of claim 1 wherein the DIR coupler has formula II or III:

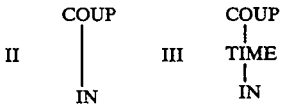

wherein:

COUP is a parent coupler moiety capable of coupling with oxidized developer;

IN is an inhibitor moiety that is joined directly or through a timing group to the parent; and TIME is a timing group that is joined to the coupling site of COUP and allows release of TIME-IN upon coupling of COUP with oxidized developer and thereafter the release of IN from TIME-IN.

15. The element of claim 14 wherein the DIR coupler has the formula:

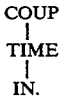

16. The photographic element of claim 14, wherein the formula for IN is selected form the group consisting of:

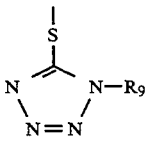

IV

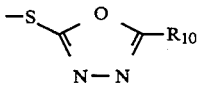

V

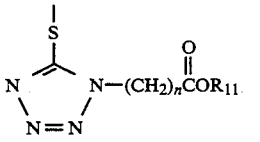

VI

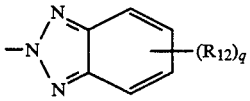

VII

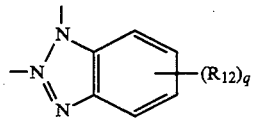

VIII

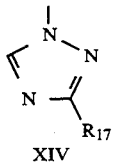

XIV and

-continued

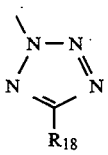

XV wherein:

$R_9$ is selected from the group consisting alkyl groups containing from 1 to 8 carbon atoms;

$R_{10}$ is selected from $R_9$ and —$SR_9$;

$R_{11}$ is an alkyl group containing 1 to 5 carbon atoms;

n is from 1 to 3; and $R_{12}$ is selected from the group consisting of hydrogen, halogen, alkoxy, phenyl, —$COOR_{13}$ and —$NHCOR_{13}$, wherein $R_{13}$ is an alkyl group or a phenyl group;

$R_{17}$ is an alkyl group, a phenyl group, —$COOR_{13}$, or —$NHCOR_{13}$ where $R_{13}$ is as defined for $R_{12}$; and $R_{18}$ is an alkyl group or a phenyl group.

17. The photographic element of claim 15 wherein TIME-IN has a formula selected form the group consisting of:

IX

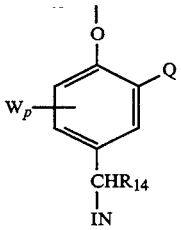

X

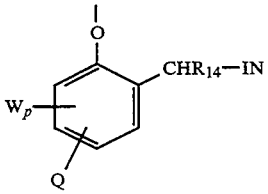

XI

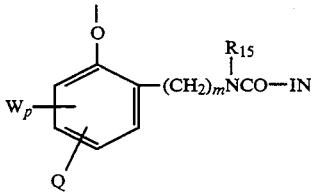

XII

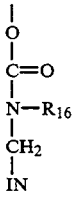

and

-continued

XIII

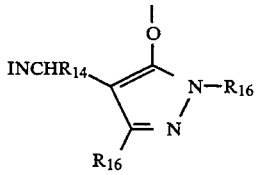

wherein:

Q and W are electron-withdrawing groups, p is 0, 1 or 2;

m is 0 or 1;

$R_{14}$ is hydrogen or an alkyl group;

$R_{15}$ is an alkyl group containing 1 to 8 carbon atoms or a phenyl group;

$R_{16}$ is an alkyl group or a phenyl group;

provided each substituent $R_{14}$, $R_{15}$, and $R_{16}$ having a substitutable hydrogen may be substituted with a substituent as provided for $R_1$, and wherein IN is an inhibitor moiety.

18. The photographic element of claim 17 wherein TIME-IN has formula IX, Q is a nitro group, $R_{14}$ is hydrogen and IN has formula:

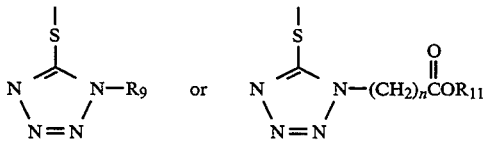

IV VI wherein:

$R_9$ is selected from the group consisting alkyl groups containing from 1 to 8 carbon atoms and phenyl;

$R_{11}$ is an alkyl group containing 1 to 5 carbon atoms; and n is from 1 to 3.

19. The photographic element of claim 17 wherein TIME-IN is of structure XI, Q is a nitro group, m is 1, p is 0, and $R_{15}$ is ethyl;

and wherein:

IN has the formula:

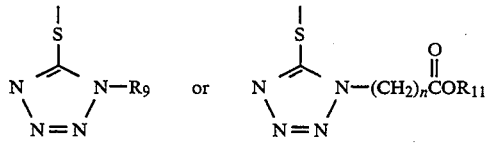

IV VI wherein:

$R_9$ is selected from the group consisting alkyl groups containing from 1 to 8 carbon atoms and phenyl;

$R_{11}$ is an alkyl group containing 1 to 5 carbon atoms; and n is from 1 to 3.

20. The element of claim 14 wherein the DIR has formula II and IN has formula VII or VIII:

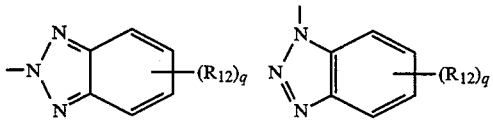

VII VIII wherein $R_{12}$ is selected from the group consisting of alkyl, halogen, alkoxy, phenyl, —$COOR_{13}$ and —$NHCOR_{13}$, wherein $R_{13}$ is an alkyl group or a phenyl group and q is 1 or 2.

21. The photographic element of claim 1 wherein the DIR coupler is selected from the group consisting of:

D1

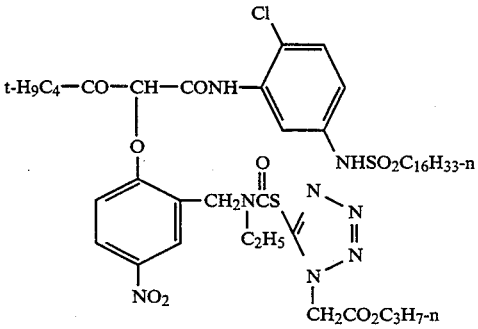

D2

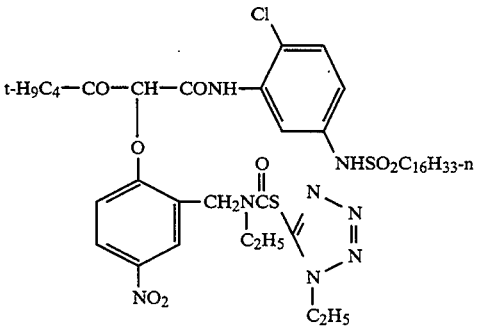

-continued
D3
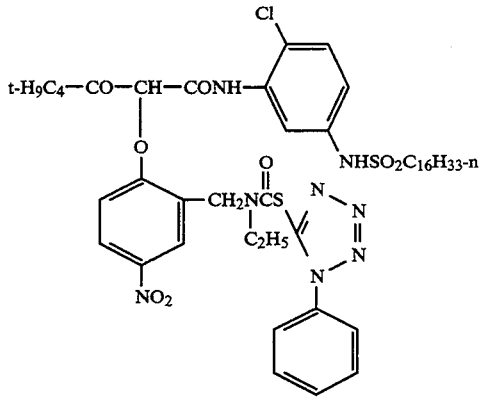
D4
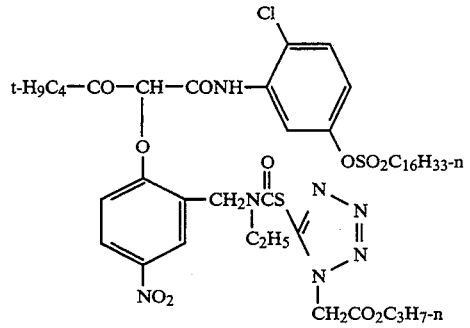
D5
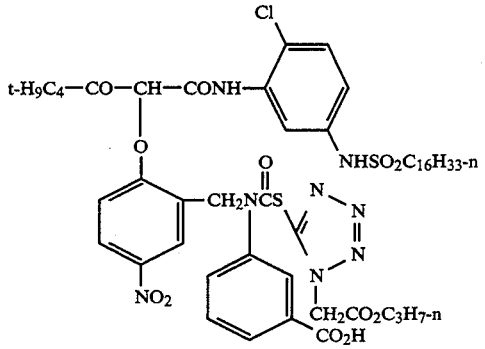
D6
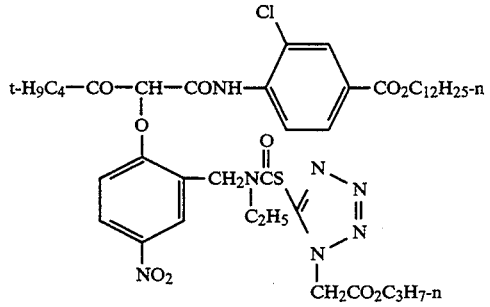
D7
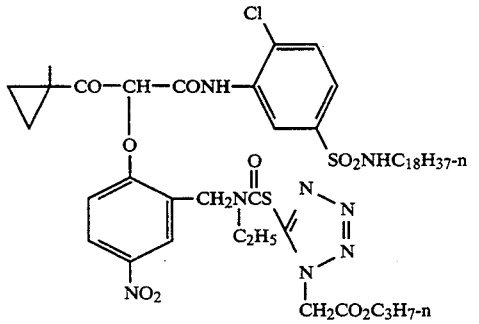
D8
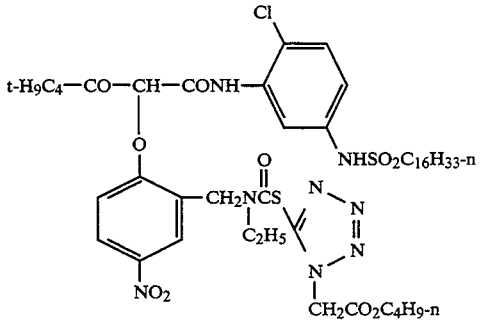
D9
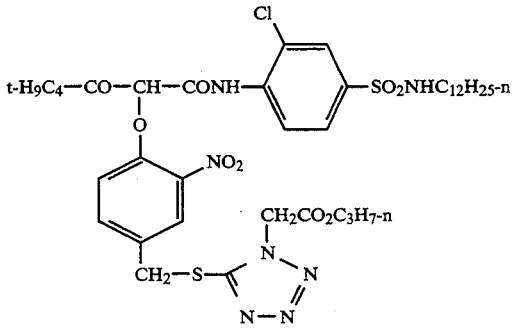
D10
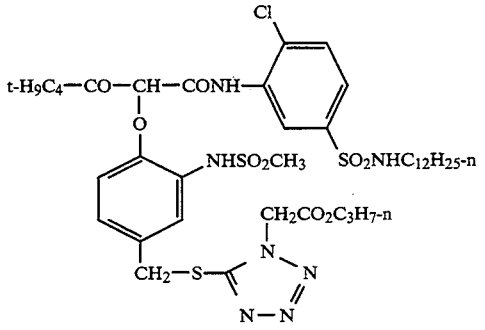

-continued
D11
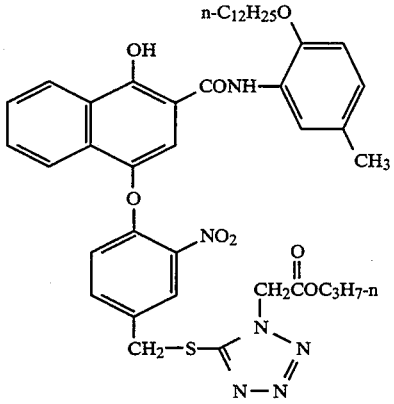
D12
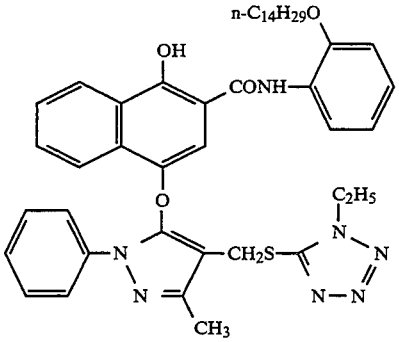
D13
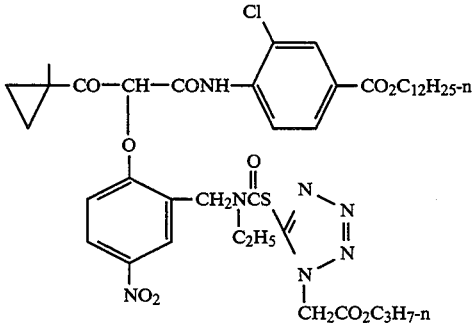
D14
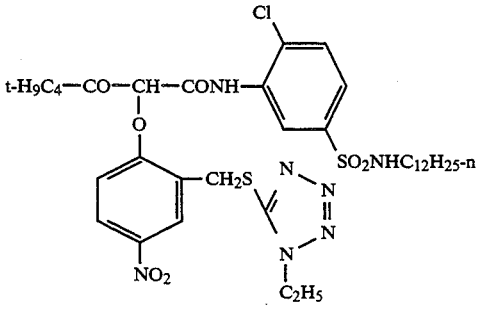
D15
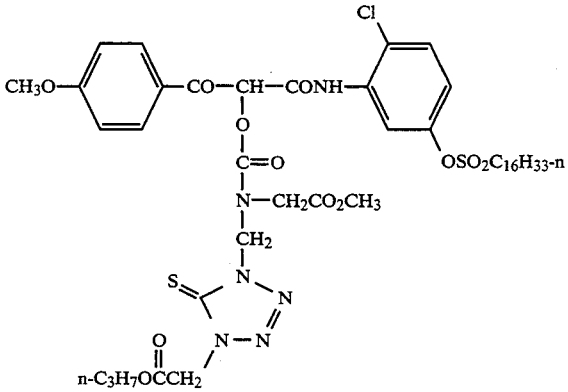
D16
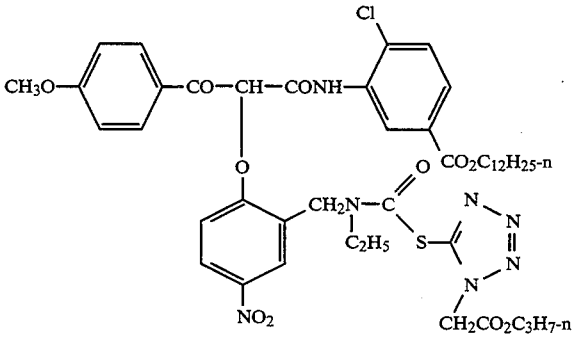

-continued
D17
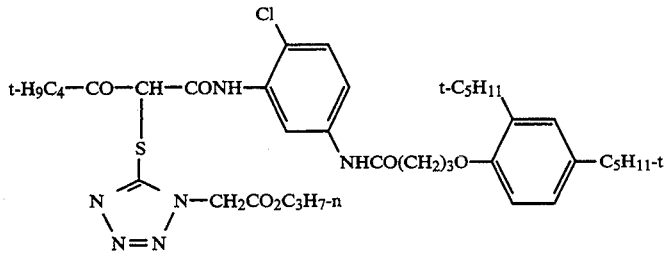
D18
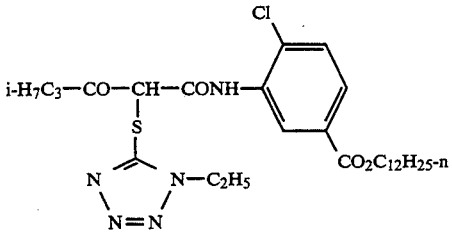
D19
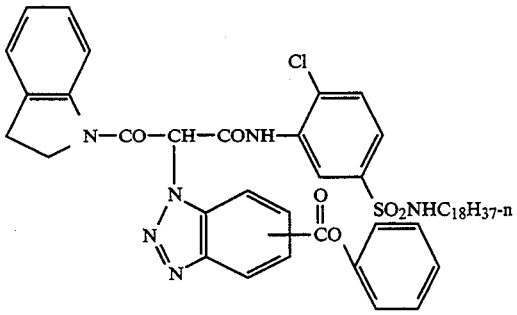
(ISO)
D20
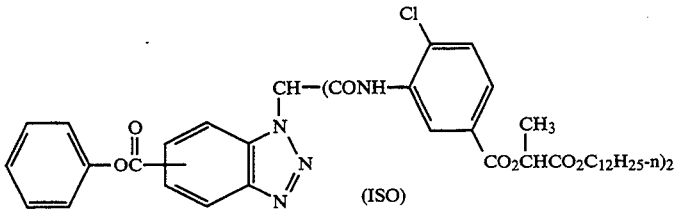
(ISO)
D21
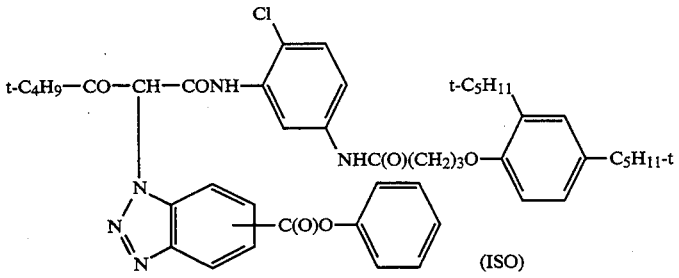
(ISO)
D22
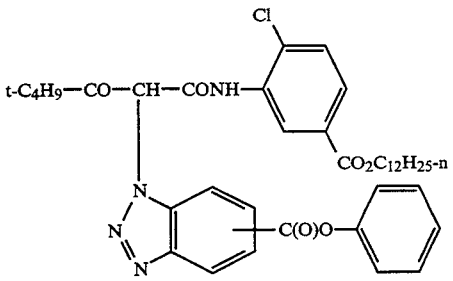
(ISO)

-continued

D23

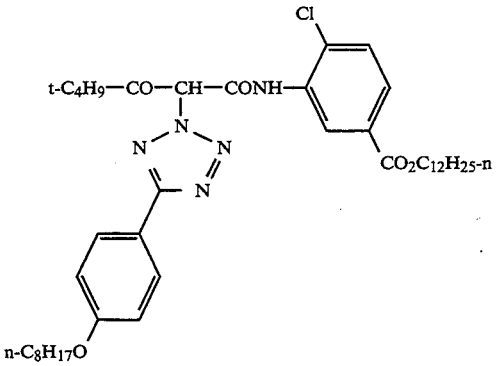

and

D24

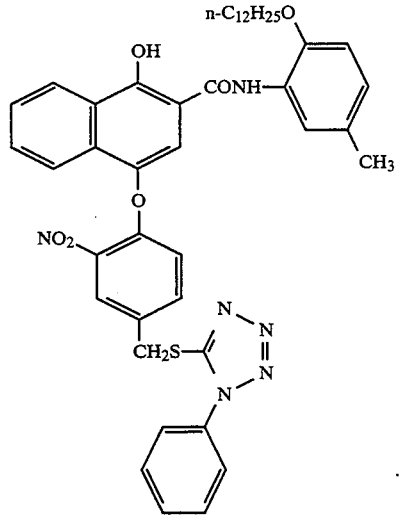

22. The photographic element of claim 21 wherein the DIR coupler has a formula selected from the group consisting of D1, D4, D6, D7, D8, D21 and D22.

23. The photographic element of claim 1 wherein said yellow image dye-forming coupler has the formula:

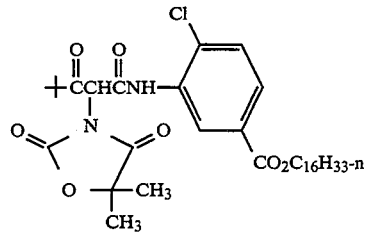

and said development inhibitor releasing coupler has one of the formulas:

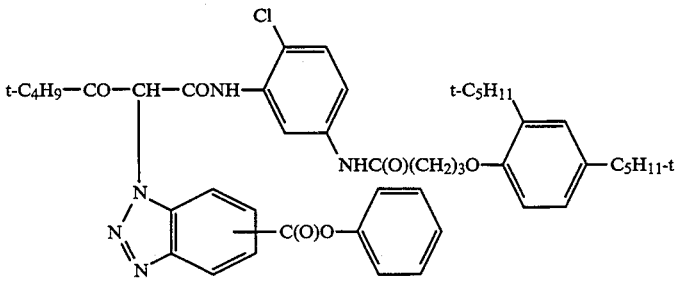

(ISO)

or

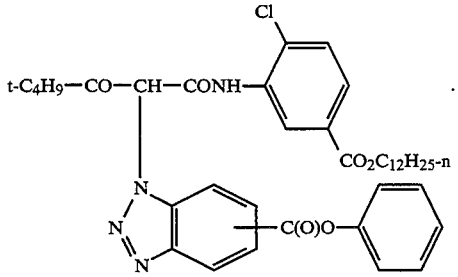

(ISO)

24. The photographic element of claim 1 wherein the coated level of the DIR coupler is 0.01 to 1.00 g/sq.m.

25. The photographic element of claim 1, additionally containing a benzoylacetanilide yellow dye-forming imaging coupler associated with the blue-light sensitive silver halide emulsion layer.

26. A method of forming an image in a photographic element as described in claim 1 which comprises exposing said element to light and thereafter developing the element with a color developer.

* * * * *